US008011759B2

(12) United States Patent
Sugahara

(10) Patent No.: US 8,011,759 B2
(45) Date of Patent: Sep. 6, 2011

(54) LIQUID DROPLET TRANSPORT APPARATUS

(75) Inventor: Hiroto Sugahara, Aichi-ken (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 412 days.

(21) Appl. No.: 12/229,469

(22) Filed: Aug. 22, 2008

(65) Prior Publication Data

US 2009/0051736 A1 Feb. 26, 2009

(30) Foreign Application Priority Data

Aug. 24, 2007 (JP) ..... 2007-218065

(51) Int. Cl.
*B41J 2/06* (2006.01)
*B41J 2/045* (2006.01)

(52) U.S. Cl. ..... 347/55; 347/70

(58) Field of Classification Search ..... 347/55, 347/68–72, 74–81, 103
See application file for complete search history.

(56) References Cited

U.S. PATENT DOCUMENTS 4,162,502 A 7/1979 Cielo et al.
4,751,532 A 6/1988 Fujimura et al.
6,568,794 B2 * 5/2003 Yamanaka et al. ..... 347/54
2003/0006140 A1 1/2003 Vacca et al.
2006/0001705 A1 1/2006 Sugahara

FOREIGN PATENT DOCUMENTS

EP 1747887 1/2007
JP 2002-55286 2/2002
JP 2006-15541 1/2006

OTHER PUBLICATIONS

European Patent Application Office Action (EP08014933.9) dated Feb. 10, 2011.

* cited by examiner

*Primary Examiner* — Geoffrey Mruk
(74) *Attorney, Agent, or Firm* — Frommer Lawrence & Haug LLP

(57) ABSTRACT

A liquid droplet transport apparatus, which is provided on a nozzle plate of an ink-jet head, including a first electrode and a second electrode which are arranged on a lower surface of the nozzle plate, a driver which applies electric potentials to the first electrode and the second electrode respectively, a resistor layer which is arranged on the lower surface of the nozzle plate and which makes electric conduction to both of the first electrode and the second electrode, and an insulating layer which covers the first electrode, the second electrode, and the resistor layer. Accordingly, the liquid droplet transport apparatus is provided, which makes it possible to transport liquid droplets over a long distance, while simplifying the arrangement for the liquid droplet transport.

15 Claims, 26 Drawing Sheets

LIQUID DROPLET TRANSPORT APPARATUS

CROSS REFERENCE TO RELATED APPLICATION

The present application claims priority from Japanese Patent Application No. 2007-218065, filed on Aug. 24, 2007, the disclosure of which is incorporated herein by reference in its entirety.

BACKGROUND OF THE INVENTION

1. Field of the Invention

The present invention relates to a liquid droplet transport apparatus which transports conductive liquid droplets along a substrate surface.

2. Description of the Related Art

Conventionally, the recording head based on the ink-jet system is widely adopted in the printer which records, for example, an image on a recording medium such as recording paper. In the recording head based on the ink-jet system, the ink is transported to the nozzles by applying the pressure to the ink contained in the ink flow passage, and the liquid droplets of the ink are jetted from the nozzles toward the recording medium. However, in the case of the recording head based on the ink-jet system as described above, the flow passage structure for applying the transport pressure and the jetting pressure to the ink and the structure of the actuator are special and complicated.

In view of the above, the present inventors have proposed a liquid droplet transport apparatus which is based on such a system that the liquid droplets are transported by utilizing the electrowetting phenomenon, as an apparatus which has a simple arrangement as compared with the conventional recording head based on the ink-jet system and which makes it possible to transport the liquid droplets of the ink to the recording medium (see, for example, Japanese Patent Application Laid-open No. 2006-15541).

The liquid droplet transport apparatus described in Japanese Patent Application Laid-open No. 2006-15541 has, on its surface, a substrate which is provided with a liquid transport passage ranging from a common liquid chamber to the recording medium, a plurality of electrodes which are arranged along the liquid transport passage on the surface of the substrate, and an insulating layer which covers the plurality of electrodes. It is noted that the phenomenon (electrowetting phenomenon) is known, wherein the larger the difference in the electric potential between the electrode covered with the insulating layer and the liquid droplet disposed on the surface of the insulating layer is, the lower the liquid repellence of the surface of the insulating layer is. Therefore, the liquid repellence of the insulating layer which covers the surfaces of the electrodes can be sequentially lowered by successively switching the electric potentials of the plurality of electrodes aligned along the liquid transport passage. Accordingly, the liquid droplet, which is derived from the common liquid chamber, can be transported along the liquid transport passage to the recording medium.

However, when the difference in the electric potential between the electrode and the liquid droplet is increased, then the liquid repellence is lowered in the area of the surface of the insulating layer which covers the electrode, but the liquid repellence is not lowered in the area of the insulating layer which is disposed between the adjoining electrodes. Therefore, if the interval of arrangement of the electrodes is excessively large as compared with the size of the liquid droplet to be transported, it is impossible to move the liquid droplet between the adjoining electrodes.

Therefore, if the liquid transport route or passage is long from the common liquid chamber to the recording medium, it is necessary that a large number of electrodes should be arranged along the liquid droplet transport passage. Further, the number of wirings is also increased in order to apply the electric potential to the electrodes respectively. In order to transport one liquid droplet, it is necessary to sequentially switch the electric potentials of the large number of electrodes of the transport passage. The electric potential control for the electrodes is complicated as well. That is, a problem arises such that the arrangement is complicated in order to transport the liquid droplets.

SUMMARY OF THE INVENTION

An object of the present invention is to provide a liquid droplet transport apparatus which makes it possible to transport liquid droplets over a long distance while simplifying the arrangement required for the liquid droplet transport.

According to an aspect of the present invention, there is provided a liquid droplet transport apparatus which transports a conductive liquid droplet, the liquid droplet transport apparatus including:

a substrate;

a first electrode and a second electrode which are arranged on a surface of the substrate;

an electric potential-applying mechanism which applies electric potentials to the first electrode and the second electrode respectively;

a resistor layer which is arranged on the surface of the substrate, which makes electric conduction to both of the first electrode and the second electrode, and which causes an electric potential drop between the first and second electrodes when the electric potentials applied to the first electrode and the second electrode by the electric potential-applying mechanism are different; and an insulating layer which covers the first electrode, the second electrode, and the resistor layer, wherein the liquid repellence of an surface of the insulating layer on which the liquid droplet is placed is lowered as an electric potential difference is increased between the surface of the insulating layer and corresponding one of the first and second electrodes and the resistor layer covered with the insulating layer.

In the liquid droplet transport apparatus of the present invention, the first electrode and the second electrode, which are disposed on the surface of the substrate (base member), are connected to one another by means of the resistor layer. Therefore, when the mutually different electric potentials are applied to the two types of the electrodes respectively, the electric potential drop (voltage drop) is caused by the resistor layer. In other words, the electric potential gradient is generated in the resistor layer. Therefore, the liquid repellence of the insulating layer is gradually lowered depending on the electric potential gradient of the resistor layer in the area to cover the resistor layer (wetting angle of the liquid droplet with respect to the surface of the insulating layer is lowered). Therefore, it is possible to transport the liquid droplet along the resistor layer between the first electrode and the second electrode.

Accordingly, even when the liquid droplet is transported over a long distance, it is unnecessary to arrange a large number of distinct electrodes between the electrode as the transport departure and the electrode as the transport destination. Further, it is also unnecessary to switch the electric potentials thereof. Therefore, it is possible to decrease the number of electrodes to be arranged on the substrate surface. Further, it is easy to control the electric potential of the electrode as well. Therefore, it is possible to simplify the arrangement for the liquid droplet transport.

In the liquid droplet transport apparatus of the present invention, the resistor layer may be arranged in an area between the first electrode and the second electrode on the substrate surface. In this arrangement, the liquid droplet can be transported in the shortest distance between the first electrode and the second electrode.

In the liquid droplet transport apparatus of the present invention, the first electrode and the second electrode may extend in parallel to each other on the substrate surface. In this arrangement, the first electrode and the second electrode are parallel to one another. Therefore, when the mutually different electric potentials are applied to the first electrode and the second electrode, the electric potential gradient is generated in the resistor layer arranged therebetween in the direction perpendicular to the extending direction of the first and second electrodes. Therefore, the liquid droplet can be always transported in the same direction (direction perpendicular to the extending direction of the first and second electrodes) irrelevant to the position of adhesion of the liquid droplet on the substrate surface. Further, it is possible to transport all of the plurality of liquid droplets adhered to the substrate surface in the same direction.

In the liquid droplet transport apparatus of the present invention, the first electrode, the second electrode, and the resistor layer may be formed of a same conductive material; and a thickness of the resistor layer may be smaller than thickness of each of the first electrode and the second electrode. In this arrangement, the first electrode, the second electrode, and the resistor layer can be formed of the identical conductive material merely by changing the thickness of the conductive material. Therefore, it is easy to form the electrodes and the resistor layer on the surface of the substrate, and it is possible to reduce the cost as well.

In the liquid droplet transport apparatus of the present invention, the electric potential-applying mechanism may apply a predetermined electric potential to the second electrode such that an electric potential difference between the second electrode and the liquid droplet is greater than an electric potential difference between the first electrode and the liquid droplet; and a liquid-attractive area, in which liquid repellence is always lower than that of the surface of the insulating layer, may be provided in a surrounding area of the substrate surface around the second electrode, the surrounding area being not covered with the insulating layer.

When the electric potential difference between the second electrode and the liquid droplet is larger than the electric potential difference between the first electrode and the liquid droplet, the liquid repellence of the insulating layer, which is brought about in the area to cover the resistor layer, is lowered at positions nearer to the side of the second electrode. Therefore, the liquid droplet is moved from the first electrode to the second electrode. In the present invention, the liquid-attractive area, in which the liquid repellence is always low as compared with the surface of the insulating layer, is provided around the second electrode as the transport destination. Therefore, the liquid droplet, which has been transported from the first electrode to the second electrode, is further moved to the liquid-attractive area. The liquid droplet, which has been moved to the liquid-attractive area, is not returned to the surface of the insulating layer irrelevant to the electric potential of the second electrode brought about thereafter. Therefore, when the liquid droplet is transported to the liquid-attractive area to complete the liquid droplet transport, the first electrode and the second electrode can be returned to have the identical electric potential so that no current is allowed to flow through the resistor layer. It is possible to suppress the electric power consumption.

In the liquid droplet transport apparatus of the present invention, the electric potential-applying mechanism may be capable of switching two modes of: a waiting mode in which the electric potentials applied to the first electrode and the second electrode are same; and a liquid droplet transport mode in which the electric potentials applied to the first electrode and the second electrode made to be different so as to move the liquid droplet along the resistor layer.

In this arrangement, the mode can be switched to the liquid droplet transport mode to apply the mutually different electric potentials to the two electrodes respectively only when it is required to transport the liquid droplet. In other words, when the liquid droplet is not transported, the waiting mode is provided so that the two electrodes have the same electric potential to provide the state in which no current is allowed to flow through the resistor layer. Therefore, it is possible to reduce the electric power consumption.

In the liquid droplet transport apparatus of the present invention, the second electrode may have a plurality of individual electrodes; the individual electrodes may be aligned with a spacing distance on the substrate surface; and adjoining individual electrodes among the individual electrodes may be connected to each other via the resistor layer.

When the transport distance of the liquid droplet is considerably long, if the first electrode and the second electrode are arranged at the position of the transport departure and the position of the transport destination respectively, then it is necessary that the electric potential difference between the both electrodes should be considerably increased. If such a situation is not provided, the electric potential gradient, which is to be generated in the resistor layer, is consequently decreased. Therefore, it is difficult to transport the liquid droplet. However, in the present invention, the plurality of second electrodes are arranged and aligned while providing the intervals between the position of the transport departure and the position of the transport destination, and the adjoining second electrodes are connected to one another by means of the resistor layer. In this arrangement, it is possible to shorten the distance between the adjoining electrodes, even when the distance between the liquid droplet transport departure and the transport destination is long. Therefore, when the electric potentials of the plurality of second electrodes are switched depending on the position of the liquid droplet, the electric potential gradient, which is generated in the resistor layer, can be increased to such an extent that the electric potential gradient is required for the liquid droplet transport. It is possible to transport the liquid droplet over a long distance.

The liquid droplet transport apparatus of the present invention may be provided in a liquid droplet discharge apparatus which discharges the liquid droplet from a predetermined discharge port; the discharge port of the liquid droplet discharge apparatus may be arranged on the surface of the substrate; the first electrode may be provided on the surface of the substrate at a surrounding position around the discharge port, and the second electrode may be provided on the substrate surface at a position separated and away from the discharge port with respect to the first electrode; the resistor layer may make electric conduction to both of the first electrode and the second electrode; and the electric potential-applying mechanism may apply a predetermined electric potential to the second electrode such that an electric potential difference between the second electrode and the liquid droplet is greater than an electric potential difference between the first electrode and the liquid droplet, and the liquid droplet, which is adhered to surroundings of the discharge port, is transported from the first electrode to the second electrode on the resistor layer.

The first electrode is provided at the surrounding position around the discharge port on the surface of the substrate, and the second electrode is provided at the position separated farther from the discharge port as compared with the first electrode. Further, the first electrode and the second electrode are connected to one another by means of the resistor layer. When the electric potential is applied to the second electrode separated farther from the discharge port as compared with the first electrode disposed around the discharge port so that the electric potential difference with respect to the liquid droplet is increased, then the electric potential drop (electric potential gradient) is generated in the resistor layer disposed between the first electrode and the second electrode, and the liquid repellence of the insulating layer to cover the resistor layer is decreased at positions nearer to the second electrode. Therefore, the liquid droplet, which is adhered to the surroundings of the discharge port, is transported from the first electrode along the resistor layer to the second electrode on the surface of the insulating layer, and the liquid droplet is moved away from the discharge port.

The liquid droplet transport apparatus of the present invention may further include a liquid chamber which is provided on the surface of the substrate and an outlet port which guides the liquid droplet from the liquid chamber to transport the liquid droplet guided from the liquid chamber on the surface of the substrate, wherein the first electrode may be provided in the vicinity of the outlet port on the surface of the substrate, and the second electrode may be provided separately away from the outlet port with respect to the first electrode on the substrate surface; the electric potential-applying mechanism may apply, to the first electrode, an electric potential different from an electric potential of the liquid contained in the liquid chamber to guide the liquid droplet from the liquid chamber; and the electric potential-applying mechanism may apply a predetermined electric potential to the second electrode such that an electric potential difference between the second electrode and the liquid droplet is greater than an electric potential difference between the first electrode and the liquid droplet, and that the liquid droplet which is guided from the liquid chamber is transported from the first electrode to the second electrode on the resistor layer.

The liquid chamber for storing the liquid is arranged on the surface of the substrate. The first electrode is provided at the position in the vicinity of the outlet port of the liquid chamber. On the other hand, the second electrode is provided at the position separated farther from the outlet port as compared with the first electrode on the surface of the substrate. Further, the first electrode and the second electrode are connected to one another by means of the resistor layer. When the electric potential is applied to the second electrode separated farther from the outlet port as compared with the first electrode disposed in the vicinity of the outlet port so that the electric potential difference with respect to the liquid droplet is increased, then the electric potential drop (electric potential gradient) is generated in the resistor layer disposed between the first electrode and the second electrode, and the liquid repellence of the insulating layer to cover the resistor layer is decreased at positions nearer to the second electrode. Therefore, the liquid droplet, which is derived from the outlet port of the liquid chamber, is transported from the first electrode along the resistor layer to the second electrode on the surface of the insulating layer so that the liquid droplet is moved away from the outlet port.

In the liquid droplet transport apparatus of the present invention, a period of time, during which the electric potential-applying mechanism applies the electric potential different from the electric potential of the liquid to the first electrode, may be adjusted to change a size of the liquid droplet to be guided from the liquid chamber.

In this arrangement, it is possible to change the size of the liquid droplet (liquid droplet volume) derived from the liquid chamber, by regulating the electric potential application time when the electric potential-applying mechanism applies, to the first electrode, the electric potential which is different from the electric potential of the liquid contained in the liquid chamber.

In the liquid droplet transport apparatus of the present invention, the outlet port may include a plurality of individual outlet ports; a plurality of individual flow passages, which are branched from the liquid chamber, may be formed on the substrate, each of the individual outlet ports being provided at one end of one of the individual flow passages; the first and second electrodes may include a plurality of first and second individual electrodes, respectively, each of the first individual electrodes and each of the second individual electrodes being arranged in one of the individual flow passages; and the electric potential-applying mechanism may apply the electric potentials independently to each of the first and second individual electrodes.

In this arrangement, the liquid droplet discharge apparatus has the plurality of individual flow passages, and the first and second individual electrodes are respectively formed for each of the individual flow passages. Therefore, the liquid droplet can be discharged from each of the plurality of individual flow passages.

In the liquid droplet transport apparatus of the present invention, each of the first individual electrodes may be formed at a boundary of one of the individual flow passages with respect to the liquid chamber; and each of the second individual electrodes may be formed in the vicinity of one of the individual outlet ports of one of the individual flow passages. In this arrangement, each of the first individual electrodes is formed at the boundary of the liquid flow passage with respect to the liquid chamber. Therefore, the liquid can be efficiently taken out from the liquid chamber. Further, each of the second individual electrodes is formed in the vicinity of the individual outlet port of the individual flow passage. Therefore, the liquid can be efficiently discharged from the outlet port.

In the liquid droplet transport apparatus of the present invention, the resistor layer may be formed of a material selected from the group consisting of graphite, carbon, high purity carbon/pyrolytic boron nitride, aluminum nitride, and tungsten. Alternatively, the insulating layer may be formed of a fluorine-based resin.

In the present invention, the first electrode and the second electrode, which are disposed on the surface of the substrate or base material, are connected to one another by means of the resistor layer. Therefore, when the mutually different electric potentials are applied to the two types of the electrodes respectively, the electric potential drop (electric potential gradient) is caused or generated in the resistor layer. Therefore, the liquid repellence of the insulating layer is gradually lowered depending on the electric potential gradient of the resistor layer in the area to cover the resistor layer. Therefore, it is possible to transport the liquid droplet along the resistor layer between the first electrode and the second electrode. Accordingly, even when the liquid droplet is transported over a relatively long distance, it is unnecessary to arrange a large number of distinct electrodes between the electrode as the transport departure and the electrode as the transport destination so that the electric potentials thereof are switched. Therefore, it is possible to simplify the arrangement or structure for the liquid droplet transport.

BRIEF DESCRIPTION OF THE DRAWINGS

FIG. 4 illustrates the liquid droplet transport operation performed by the liquid droplet transport apparatus of the first embodiment, wherein

FIG. 7 illustrates the liquid droplet transport operation performed by the liquid droplet transport apparatus of the second modified embodiment, wherein

DESCRIPTION OF THE PREFERRED EMBODIMENTS

First Embodiment

Figure 1:
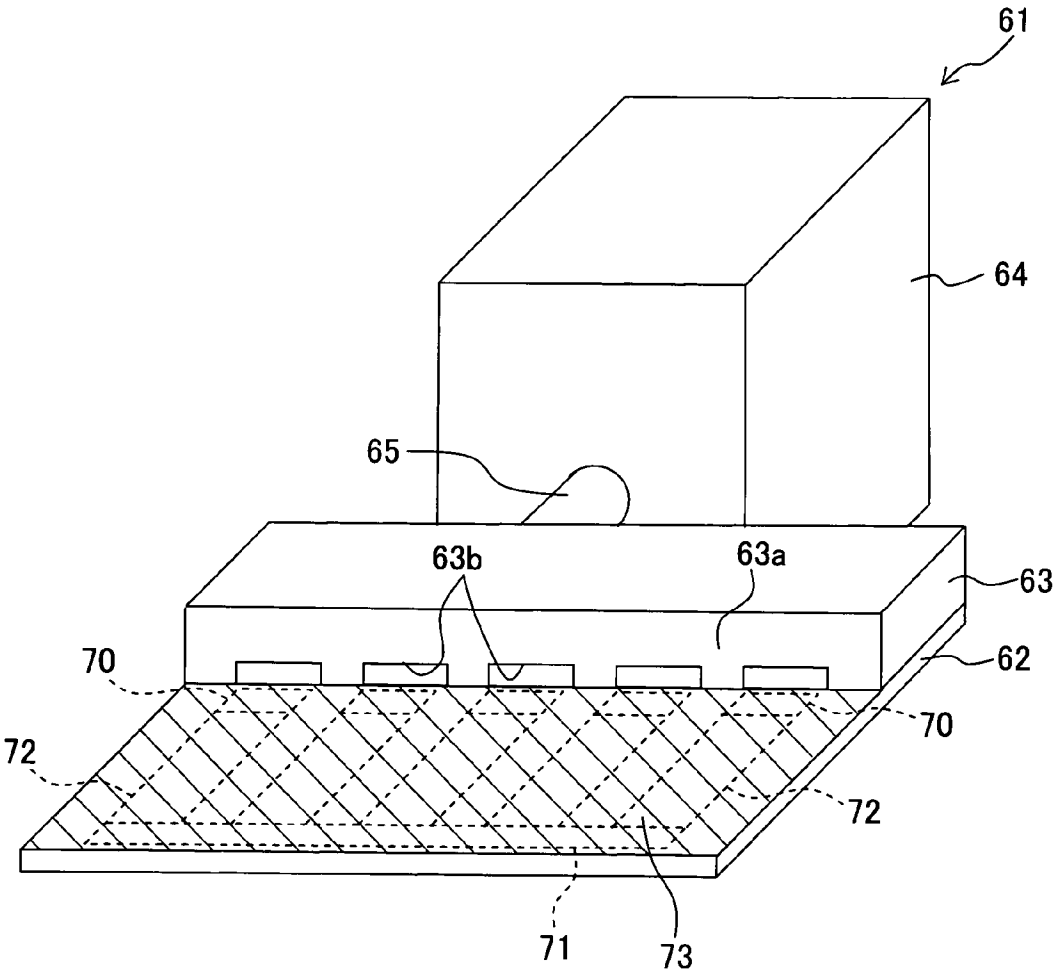
FIG. 1 shows a schematic arrangement illustrating a liquid droplet transport apparatus according to a first embodiment.
Figure 2:
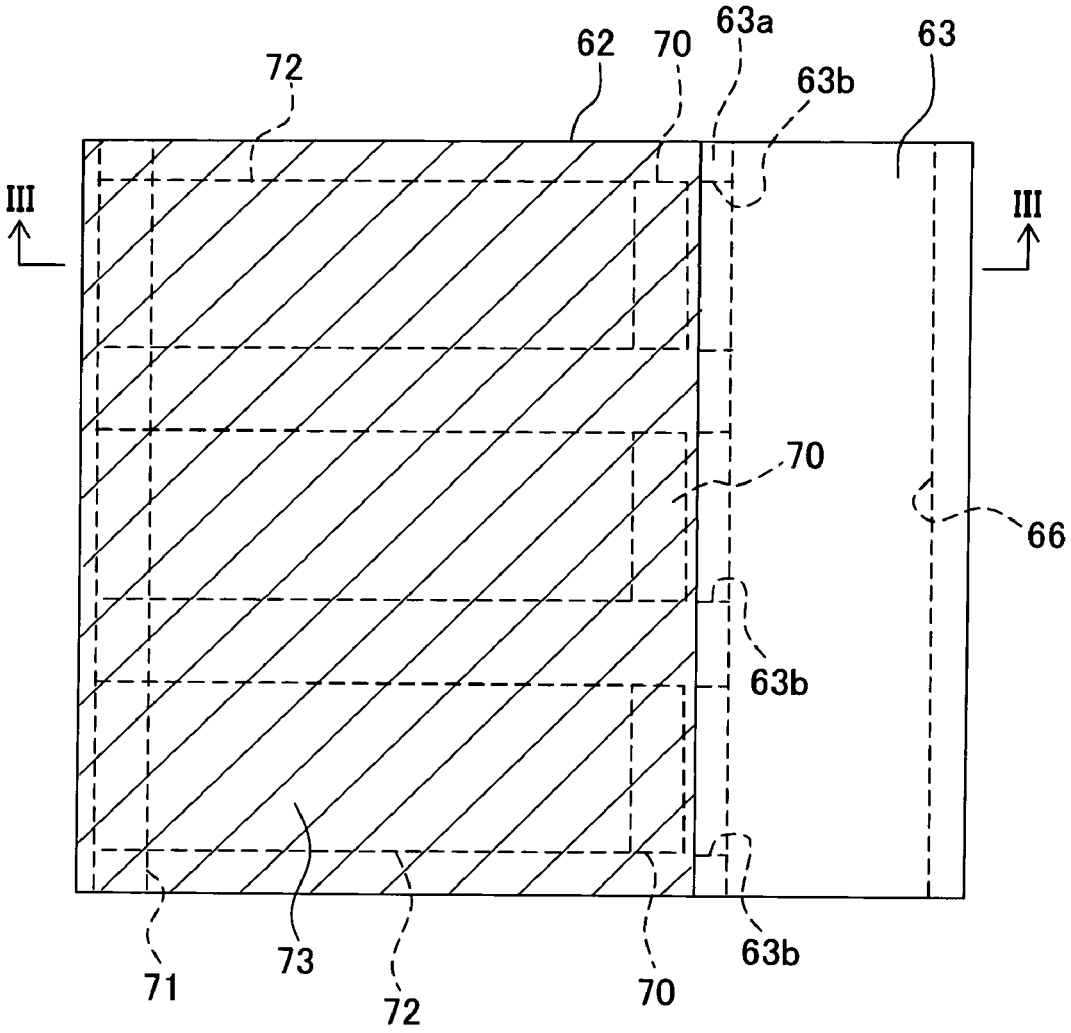
FIG. 2 shows a partial magnified plan view illustrating the liquid droplet transport apparatus.
Figure 3:
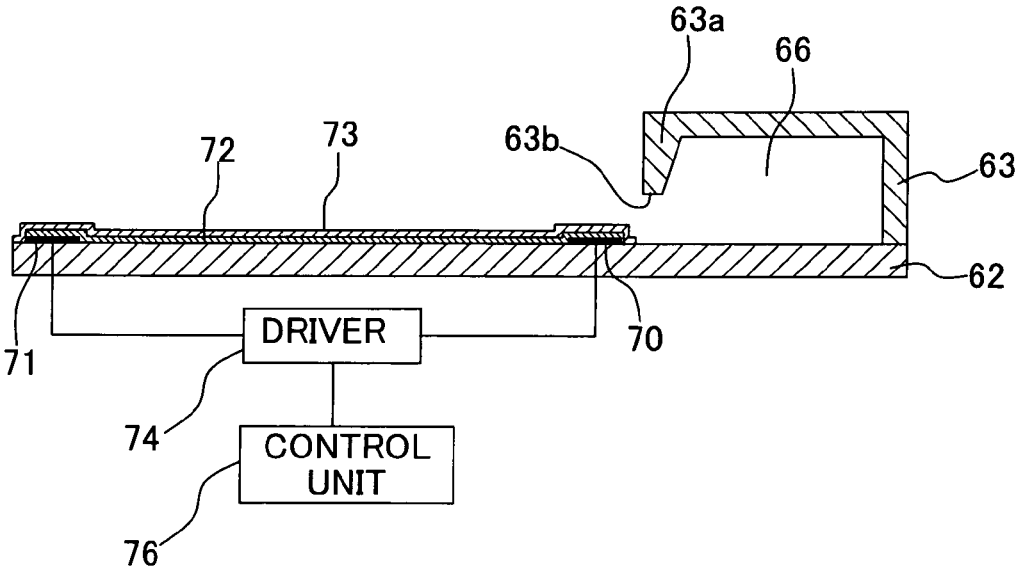
FIG. 3 shows a sectional view taken along a line III-III shown in FIG. 2.

Next, a first embodiment of the present invention will be explained. FIG. 1 shows a perspective view illustrating a schematic arrangement of a liquid droplet transport apparatus of the first embodiment. FIG. 2 shows a plan view illustrating the liquid droplet transport apparatus. FIG. 3 shows a sectional view taken along a III-III line shown in FIG. 1. FIG. 4 illustrates the liquid droplet transport operation of the liquid droplet transport apparatus. The liquid droplet transport apparatus of the first embodiment is one of the printing apparatus which transports the liquid droplets of the ink along the surface of the substrate to adhere the liquid droplets to the recording paper P2 (see FIG. 4) arranged on the forward end side of the substrate. Accordingly, the liquid droplet discharge apparatus records, for example, the image and the letters on the recording paper P2.

As shown in FIGS. 1 to 3, the liquid droplet transport apparatus 61 includes a flat plate-shaped substrate 62 which is arranged along the horizontal plane, and an ink chamber-forming member 63 which is joined to the upper surface of the substrate 62. It is enough for the substrate 62 that the insulating property is exhibited on at least the upper surface thereof. For example, it is possible to use a material formed of a high molecular resin material such as polyimide. The box-shaped ink chamber-forming member 63 is joined to the upper surface at one end of the substrate 62. Accordingly, a common ink chamber 66 (liquid chamber), which stores the conductive ink, is formed between the upper surface of the substrate 62 and the ink chamber-forming member 63. The common ink chamber 66 is connected to an ink tank 64 via a tube 65. The ink is supplied from the ink tank 64 to the common ink chamber 66. A plurality of outlets ports 63*b*, which are provided to derive the ink from the internal common ink chamber 66, are formed on the wall section 63*a* of the ink chamber-forming member 63 disposed on the front side of the paper surface of FIG. 1, while providing equal intervals.

The electric potential of the ink contained in the common ink chamber 66 is approximately retained at the ground electric potential. The electric potential of the ink contained in the common ink chamber 66 can be maintained approximately at the ground electric potential, for example, such that the ink chamber-forming member 63 is formed of a metal material such as stainless steel, and the ink chamber-forming member 63 is retained at the ground electric potential. Alternatively, the electric potential of the ink may be also maintained at the ground electric potential as follows. That is, a ground electrode, which is always retained at the ground electric potential, is arranged on the inner surface of the common ink chamber 66 (on the upper surface of the substrate 62 or on the inner surface of the ink chamber-forming member 63), and the ink contained in the common ink chamber 66 is allowed to make contact with the ground electrode.

A plurality of first electrodes 70 are arranged at positions on the upper surface of the substrate 62 in the vicinity of the plurality of outlet ports 63*b* formed on the wall section 63*a* of the ink chamber-forming member 63. In other words, the plurality of first electrodes 70 are arranged and aligned along the wall section 63*a* of the ink chamber-forming member 63 corresponding to the plurality of outlet ports 63*b* respectively. A second electrode 71, which is separated from the outlet ports 63*b* as compared with the first electrodes 70, is arranged on the upper surface of the substrate 62 disposed at the end portion (front end as shown in FIG. 1) on the side opposite to the ink chamber-forming member 63. The second electrode 71 extends in parallel to the direction of arrangement of the first electrodes 70 over the plurality of first electrodes 70. As shown in FIG. 3, the plurality of first electrodes 70 and the second electrode 71 are connected to a driver 74 respectively.

A plurality of resistor layers 72, which correspond to the plurality of first electrodes 70 respectively, are arranged in the area of the upper surface of the substrate 62 disposed between the plurality of first electrodes 70 and the second electrode 71. The plurality of resistor layers 72 are arranged while providing intervals in relation to the direction of arrangement of the first electrode 70, and they are independent from each other. Each of the resistor layer 72 is in conduction with both of the corresponding first electrode 70 and the second electrode 71. In other words, the plurality of first electrodes 70 and the second electrode 71 are connected to one another via the plurality of resistor layers 72. Therefore, the voltage drop (electric-potential gradient) is generated in the resistor layer 72 arranged between the both when the electric potential difference exists between the first electrode 70 and the second electrode 71.

An insulating layer 73 is formed on the upper surface of the substrate 62 so that the first electrodes 70, the second electrode 71, and the resistor layers 72 are completely covered therewith. The insulating layer 73 is composed of, for example, a fluorine-based resin. As described later on, the larger the electric potential difference between the liquid droplets of the ink existing on the surface and the first electrode 70, the second electrode 71, and the resistor layer 72 is, the lower the liquid repellence (wetting angle) on the surface of the insulating layer 73 to cover them is.

The driver 74 applies any one of the ground electric potential and the transport electric potential to the plurality of first electrodes 70 and the second electrode 71 on the basis of the instruction supplied from a control unit 76 which controls the overall operation of the liquid droplet transport apparatus 61. More specifically, the driver 74 selects one mode of the waiting mode in which the liquid droplet is not transported (see FIG. 4A), the liquid droplet-deriving mode in which the liquid droplet 80 is derived from the common ink chamber 66 (see FIG. 4B), and the liquid droplet transport mode in which the derived liquid droplet 80 is transported (see FIG. 4C) on the basis of the instruction supplied from the control unit 76 so that the electric potentials of the first electrode 70 and the second electrode 71 are switched depending on the selected mode.

Figure 4A:
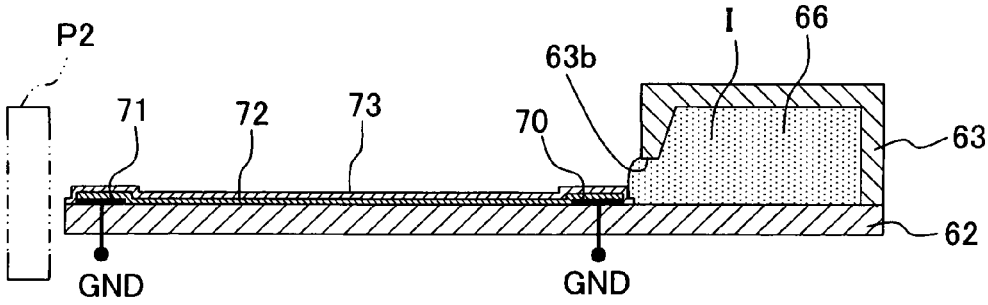
FIG. 4A shows a waiting state in which no liquid droplet is derived.

The function of the liquid droplet transport apparatus 61 of the first embodiment will be explained with reference to FIG. 4. When the liquid droplet is not transported (when the recording is not performed on the recording paper P2), the control unit 76 allows the driver 74 to select the waiting mode. Accordingly, as shown in FIG. 4A, the driver 74 applies the ground electric potential to all of the first electrodes 70 and the second electrode 71. In this situation, the electric potential difference is hardly generated between the electric potentials of the first electrode 70 and the ink contained in the common ink chamber 66. Therefore, the liquid repellence is still high on the surface of the insulating layer 73 which covers the first electrode 70. The ink I is not derived from the common ink chamber 66 via the outlet port 63*b*.

Figure 4B:
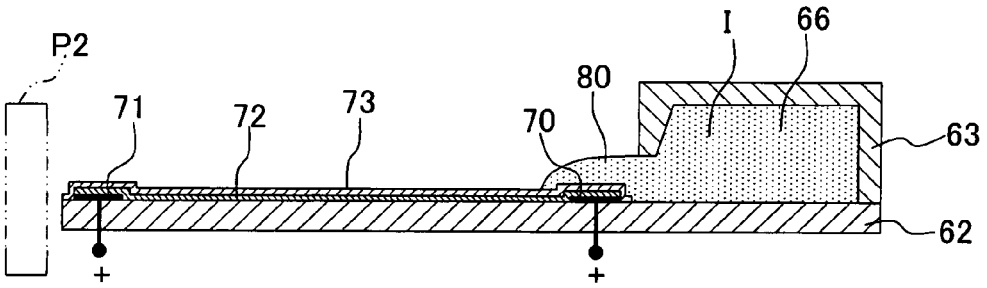
FIG. 4B shows a state during the derivation of the liquid droplet.

On the other hand, when it is required to derive the liquid droplet from a certain outlet port 63*b* so that the liquid droplet is transported to the recording paper P2 positioned on the forward end side of the substrate 62, the control unit 76 allows the driver 74 to select the liquid droplet-deriving mode. Accordingly, as shown in FIG. 4B, the driver 74 applies the transport electric potential (for example, 30 V) to the first electrode 70 corresponding to the outlet port 63*b* from which it is intended to derive the liquid droplet. Further, the driver 74 also applies the transport electric potential to the second electrode 71.

As described above, both of the electric potentials of the first electrode 70 and the second electrode 71 corresponding to the predetermined outlet port 63*b* are the transport electric potential. Therefore, the electric potential is the transport electric potential in the entire region of the resistor layer 72 corresponding to the first electrode 70. No electric potential resistance is generated in the resistor layer 72. In this situation, the liquid repellence (wetting angle) of the surface of the insulating layer 73 is lowered in the entire region of the area to cover the first electrode 70, the second electrode 71, and the resistor layer 72. Therefore, the liquid droplet 80 of the ink I is derived from the interior of the common ink chamber 66 via the outlet port 63*b* to the surface of the insulating layer 73.

The ink I is continuously derived from the outlet port 63*b* during the period in which the transport electric potential is applied from the driver 74 to the first electrode 70. In other words, the amount (liquid droplet volume) of the liquid droplet 80 derived from the outlet port 63*b* depends on the time in which the transport electric potential is applied to the first electrode 70. Therefore, when the driver 74 applies the transport electric potential to the first electrode 70 for a predetermined period of time on the basis of the instruction supplied from the control unit 76, the liquid droplet 80, which is in an amount corresponding to the predetermined period of time, can be derived from the outlet port 63*b*. More specifically, when the driver 74 regulates the period of time to apply the transport electric potential to the first electrode 70, it is possible to change the size of the liquid droplet 80 to be derived from the common ink chamber 66. Accordingly, it is possible to derive a plurality of types of liquid droplets 80 having different sizes (volumes) from one outlet port 63*b*.

When the transport electric potential is applied from the driver 74 to the first electrode 70 for the predetermined period of time, and the liquid droplet 80 in the desired amount is derived from the outlet port 63*b*, then the control unit 76 allows the driver 74 to select the liquid droplet transport mode. Accordingly, the driver 74 switches the electric potential of the first electrode 70 from the transport electric potential to the ground electric potential. The transport electric potential is still applied to the second electrode 71.

Figure 4C:
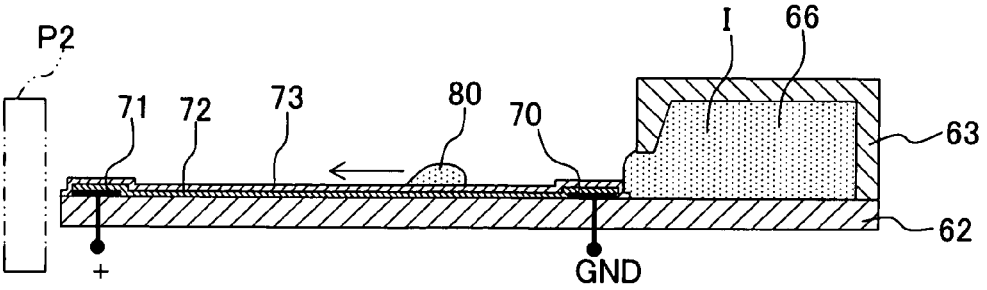
FIG. 4C shows a state during the liquid droplet transport.

In this situation, the electric potential difference almost disappears between the first electrode 70 and the liquid droplet 80 derived from the outlet port 63*b*. The liquid repellence of the insulating layer 73 in the area to cover the first electrode 70 is increased. The transport electric potential is applied to the second electrode 71. Therefore, the electric potential difference from the liquid droplet 80 is increased as compared with the first electrode 70. Therefore, the electric potential gradient is generated in the resistor layer 72 disposed between the first electrode 70 and the second electrode 71. The liquid repellence of the insulating layer 73 to cover the resistor layer 72 is lowered at positions nearer to the second electrode 71. Therefore, as shown in FIG. 4C, the liquid droplet 80, which is derived to the surface of the insulating layer 73, is transported from the first electrode 70 toward the second electrode 71 along the resistor layer 72. Further, the liquid droplet 80 is adhered to the recording paper P2 positioned on the forward end side of the substrate 62.

When a certain predetermined period of time elapses after the electric potential of the first electrode 70 is switched from the transport electric potential to the ground electric potential, the control unit 76 judges that the transported liquid droplet 80 is adhered to the recording paper P2. The control unit 76 allows the driver 74 to select the waiting mode. Accordingly, the driver 74 returns the electric potentials of all of the first electrodes 70 and the second electrode 71 to the ground electric potential (FIG. 4A).

As explained above, in the liquid droplet transport apparatus 61 of the first embodiment, the first electrode 70 which is arranged in the vicinity of the outlet port 63*b* on the upper surface of the substrate 62 and the second electrode 71 which is arranged at the position separated farther from the outlet port 63*b* as compared with the first electrode 70 are connected to one another by means of the resistor layer 72. Therefore, even when the distance (transport distance of the liquid droplet) between the first electrode 70 as the transport departure and the second electrode 71 as the transport destination is relatively long, it is unnecessary that a large number of intermediate electrodes are arranged to transport the liquid droplet between the two types of the electrodes 70, 71, and it is also unnecessary to diligently switch the electric potentials of the intermediate electrodes. Therefore, it is possible to simplify the arrangement required to transport the liquid droplet.

Additionally, the second electrode 71 extends in parallel to the direction of arrangement of the plurality of first electrodes 70 over the plurality of first electrodes 70. In other words, one second electrode 71 is commonly provided for the plurality of first electrodes 70. Therefore, it is easy to switch the electric potential of the second electrode 71 which is the electrode as the transport destination of the liquid droplet. Further, it is enough to provide a small number of wirings to be led from the second electrode 71.

The plurality of resistor layers 72 are provided while providing the intervals corresponding to the plurality of first electrodes 70, and they are independent from each other. Therefore, the liquid droplet, which is derived to the surface of a certain first electrode 70, is prevented from being moved to the second electrode 71 while being transferred to the transport passage or route corresponding to the adjoining first electrode 70. Therefore, it is possible to adhere the liquid droplet 80 to the desired position of the recording paper P2.

Next, an explanation will be made about modified embodiments in which various modifications are applied to the first embodiment described above. However, the parts or components, which are constructed in the same manner as in the first embodiment described above, are designated by the same reference numerals, any explanation of which will be appropriately omitted.

First Modified Embodiment

In the first embodiment described above, one second electrode 71 is commonly provided for the plurality of first electrodes 70 (see FIGS. 1 and 2). Therefore, when the liquid droplet transport mode is selected as shown in FIG. 4C, the ground electric potential is applied to the plurality of first electrodes 70 by the driver 74, and the transport electric potential is applied to the second electrode 71 by the driver 74, then the electric potential gradients are generated in all of the resistor layers 72 respectively. In other words, the current is consequently allowed to flow through the resistor layer 72 in the passage or route in which the liquid droplet 80 is not derived as well.

Figure 5:
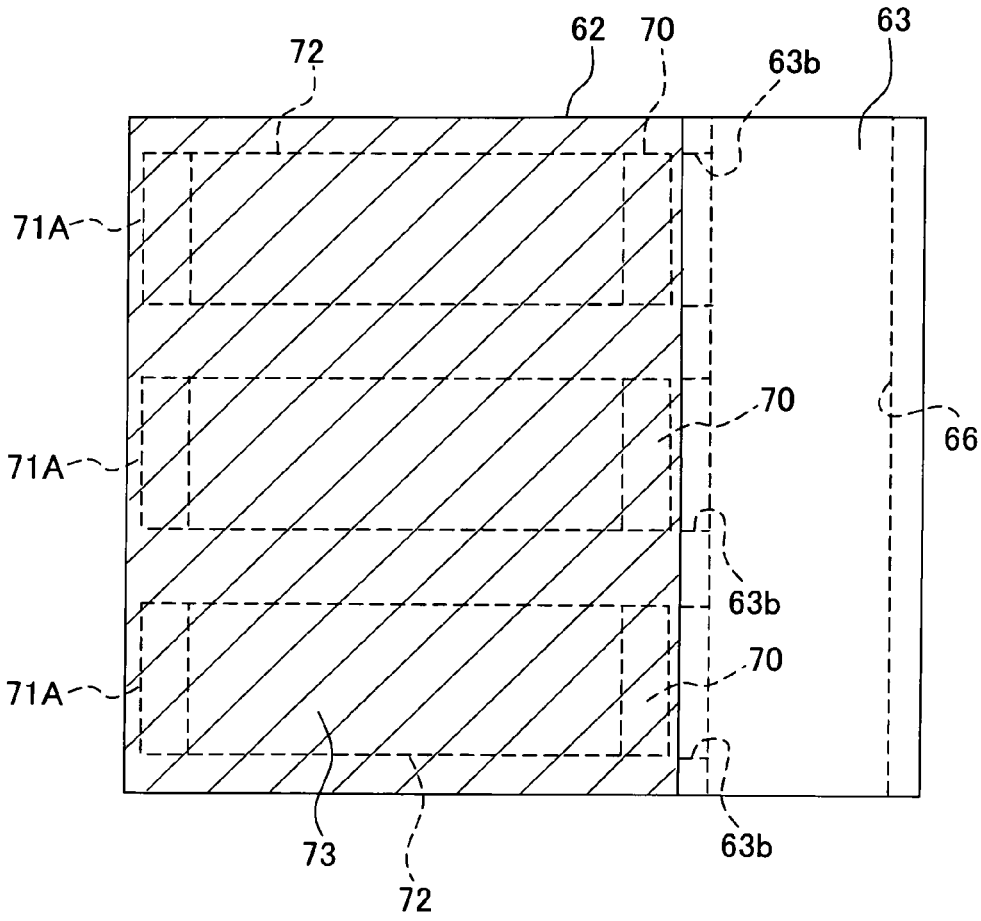
FIG. 5 shows a partial magnified plan view illustrating a liquid droplet transport apparatus according to a first modified embodiment.

Accordingly, as shown in FIG. 5, it is also appropriate that a plurality of second electrodes 71A, which correspond to the plurality of first electrodes 70 respectively, are provided independently from each other on the upper surface of the substrate 62. In this case, the transport electric potential can be applied from the driver 74 to only the second electrode 71 disposed in the transport passage in which the liquid droplet is derived from the outlet port 63*b*. Therefore, the electric potential gradient is generated in only the resistor layer 72 disposed in the passage. Therefore, it is possible to reduce the electric power consumption.

Second Modified Embodiment

Figure 6:
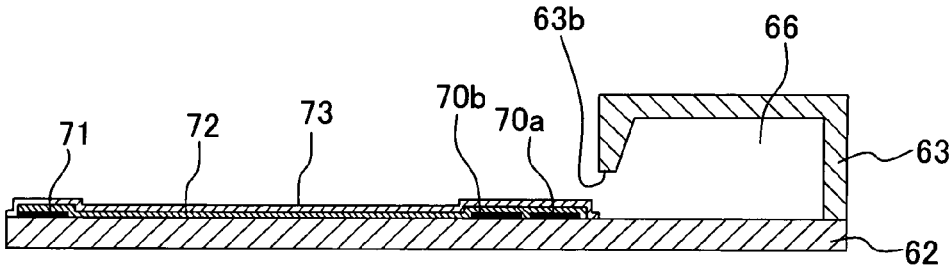
FIG. 6 shows a sectional view illustrating the liquid droplet transport apparatus of a second modified embodiment corresponding to FIG. 3.

In the first embodiment described above, the first electrode 70, which is provided at the position in the vicinity of the outlet port 63*b*, serves as both of the electrode which is provided to derive the liquid droplet from the common ink chamber 66 via the outlet port 63*b* and the transport departure electrode which is provided to transport the derived liquid droplet toward the second electrode 71 disposed on the side of the recording paper P2. However, as shown in FIG. 6, it is also appropriate that two first electrodes 70*a*, 70*b*, which serve as the electrode for deriving the liquid droplet and the transport departure electrode for the liquid droplet respectively, are provided and aligned in the direction to make separation from the outlet port 63*b* (transport direction of the liquid droplet).

Figure 7A:
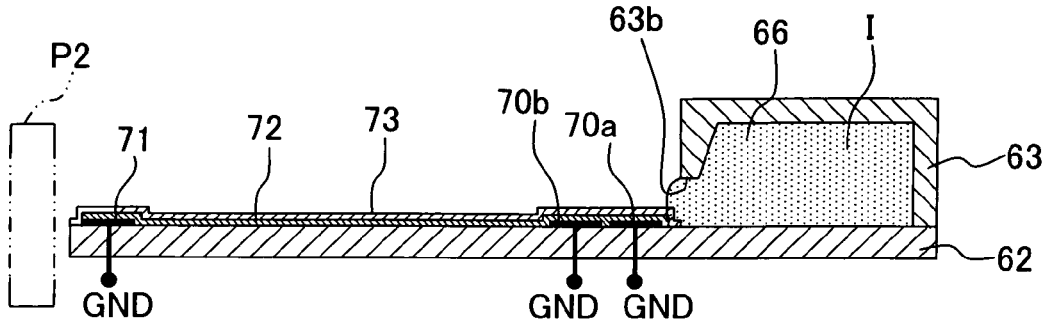
FIG. 7A shows a waiting state in which no liquid droplet is derived.

The function of the liquid droplet transport apparatus of the second modified embodiment will be explained with reference to FIG. 7. When the liquid droplet is not transported, as shown in FIG. 7A, the driver 74 applies the ground electric potential to the two first electrodes 70*a*, 70*b* and the second electrode 71 (waiting mode). In this situation, the electric potential difference is hardly generated between the electric potentials of the first electrode 70*a* and the ink I contained in the common ink chamber 66. Therefore, the liquid repellence is still high on the surface of the insulating layer 73 to cover the first electrode 70*a*. The liquid droplet is not derived from the common ink chamber 66 via the outlet port 63*b*.

Figure 7B:
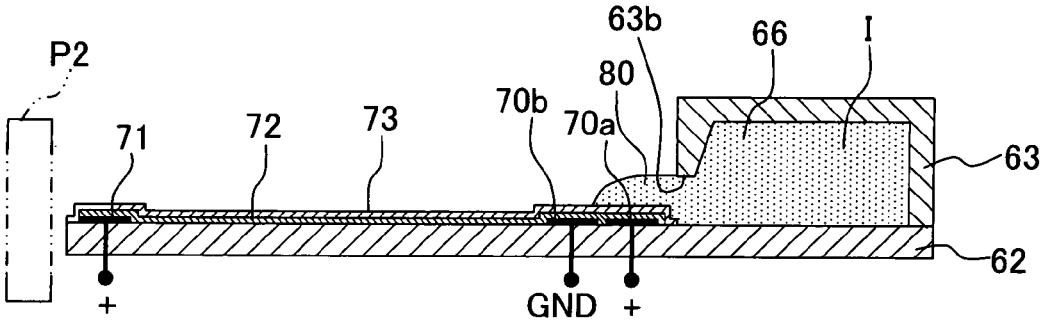
FIG. 7B shows a state during the derivation of the liquid droplet.

Subsequently, when the liquid droplet is derived from the outlet port 63*b*, as shown in FIG. 7B, then the driver 74 applies the transport electric potential to the first electrode 70*a* for deriving the liquid droplet as arranged at the position in the vicinity of the outlet port 63*b*, and the driver 74 also applies the transport electric potential to the second electrode 71 (liquid droplet-deriving mode). In this situation, the electric potential of the other first electrode 70*b* is still the ground electric potential.

Accordingly, the electric potential difference arises between the first electrode 70*a* and the ink I, that is, the electric potential difference arises between the surface of the insulating layer 73 and the first electrode 70*a*. Therefore, the liquid repellence of the insulating layer 73 is lowered in the area to cover the first electrode 70*a*, and the liquid droplet 80 is derived from the outlet port 63*b*. However, the transport electric potential is not applied to the adjoining first electrode 70*b*, and the liquid repellence of the insulating layer 73 is still high in this area. Therefore, the derived liquid droplet 80 is not moved to the surface of the first electrode 70*b*. Therefore, unlike the first embodiment described above, the amount of the liquid droplet 80 to be derived from the outlet port 63*b* is determined, for example, by the electrode areal size of the first electrode 70*a* in the second embodiment. The amount of the liquid droplet 80 does not depend on the period of time in which the transport electric potential is applied to the first electrode 70*a* for deriving the liquid droplet.

Figure 7C:
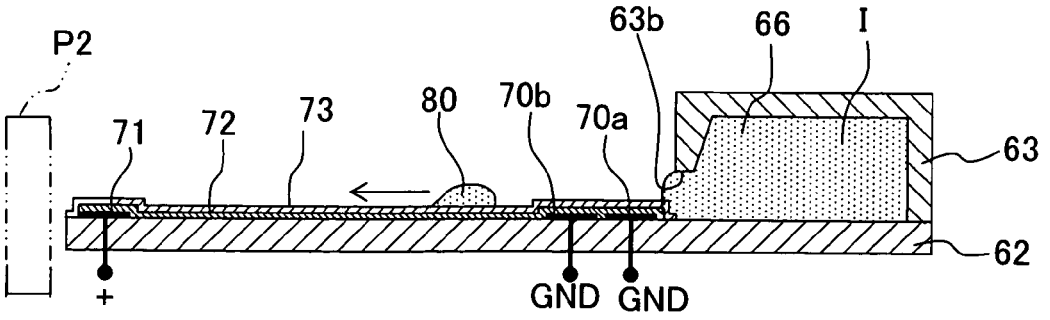
FIG. 7C shows a state during the liquid droplet transport.

Subsequently, as shown in FIG. 7C, the driver 74 switches the electric potential of the first electrode 70*a* for deriving liquid droplet to the ground electric potential. Accordingly, a state is given, in which the liquid repellence of the insulating layer 73 is high in the area to cover the two first electrodes 70*a*, 70*b*. Further, the transport electric potential is applied to the second electrode 71. Therefore, the electric potential difference from the liquid droplet 80 is large as compared with the first electrodes 70*a*, 70*b*. Therefore, the electric potential gradient is generated in the resistor layer 72 disposed between the first electrode 70*b* and the second electrode 71. The liquid repellence of the insulating layer 73 to cover the resistor layer 72 is lowered at positions disposed nearer to the second electrode 71. Therefore, as shown in FIG. 7C, the liquid droplet 80, which is derived to the surface of the insulating layer 73, is transported from the first electrode 70*b* toward the second electrode 71 along the resistor layer 72. Further, the liquid droplet 80 is adhered to the recording paper P2 positioned on the forward end side of the substrate 62.

A liquid-attractive area, in which the liquid repellence is always lower than that of the surface of the insulating layer 73, may be provided in the surrounding area around the second electrode 71 on the upper surface of the substrate 62, in the same manner as in the second embodiment as described later on. In this case, the liquid droplet, which has been transported to the second electrode 71, is moved to the liquid-attractive area from the surface of the insulating layer 73 (see FIGS. 11 and 12 of the second embodiment).

Further, modifications, which are the same as or equivalent to modifications applied to the second embodiment as described later on, can be also applied to the first embodiment. For example, a plurality of second electrodes 71, which serve as the liquid droplet transport destinations, may be arranged and aligned on the upper surface of the substrate 62 while providing the intervals in the liquid droplet transport direction, and the second electrodes 71 may be connected to one another by means of the resistor layer 72 (see the fifth modified embodiment (FIGS. 19 to 25)).

Second Embodiment

Next, a second embodiment of the present invention will be explained. The second embodiment resides in an exemplary application of the present invention to a liquid droplet transport apparatus which is provided on a liquid droplet discharge surface of an ink-jet head (liquid droplet discharge apparatus) for discharging the ink from nozzles and which transports the liquid droplets adhered to the liquid droplet discharge surface.

Figure 8:
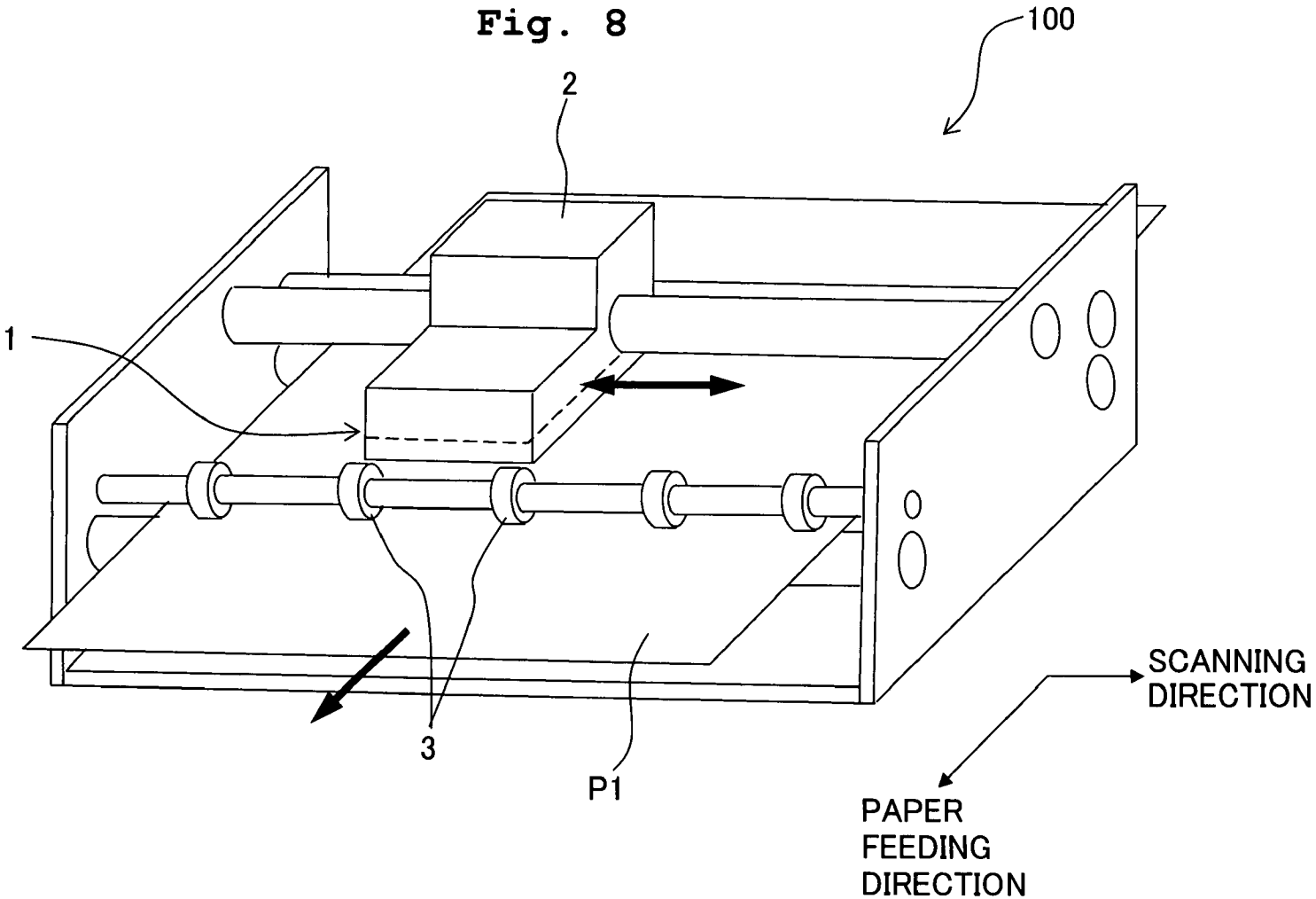
FIG. 8 shows a schematic arrangement illustrating an ink-jet printer according to a second embodiment of the present invention.

At first, an explanation will be made about an ink-jet head and a printer provided with the ink-jet head. FIG. 8 shows a schematic arrangement of the printer. As shown in FIG. 8, the ink-jet printer 100 comprises a carriage 2 which is movable in the left-right direction (scanning direction) in FIG. 8, the serial type ink-jet head 1 which is provided on the carriage 2 and which discharges the inks to the recording paper P1, a transport roller 3 which transports the recording paper P1 in the frontward direction in FIG. 8, and a control unit 6 (see FIGS. 11 and 16) which controls respective constitutive components of the printer 100 including, for example, the ink-jet head 1. In the ink-jet printer 100, the inks are discharged to the recording paper P1 from the nozzles 20 of the ink-jet head 1, while moving the ink-jet head 1 together with the carriage 2. Simultaneously, in the ink-jet printer 100, the recording paper P1 is transported in the frontward direction by means of the transport roller 3. Accordingly, for example, a desired image and/or letters are recorded on the recording paper P1.

Figure 9:
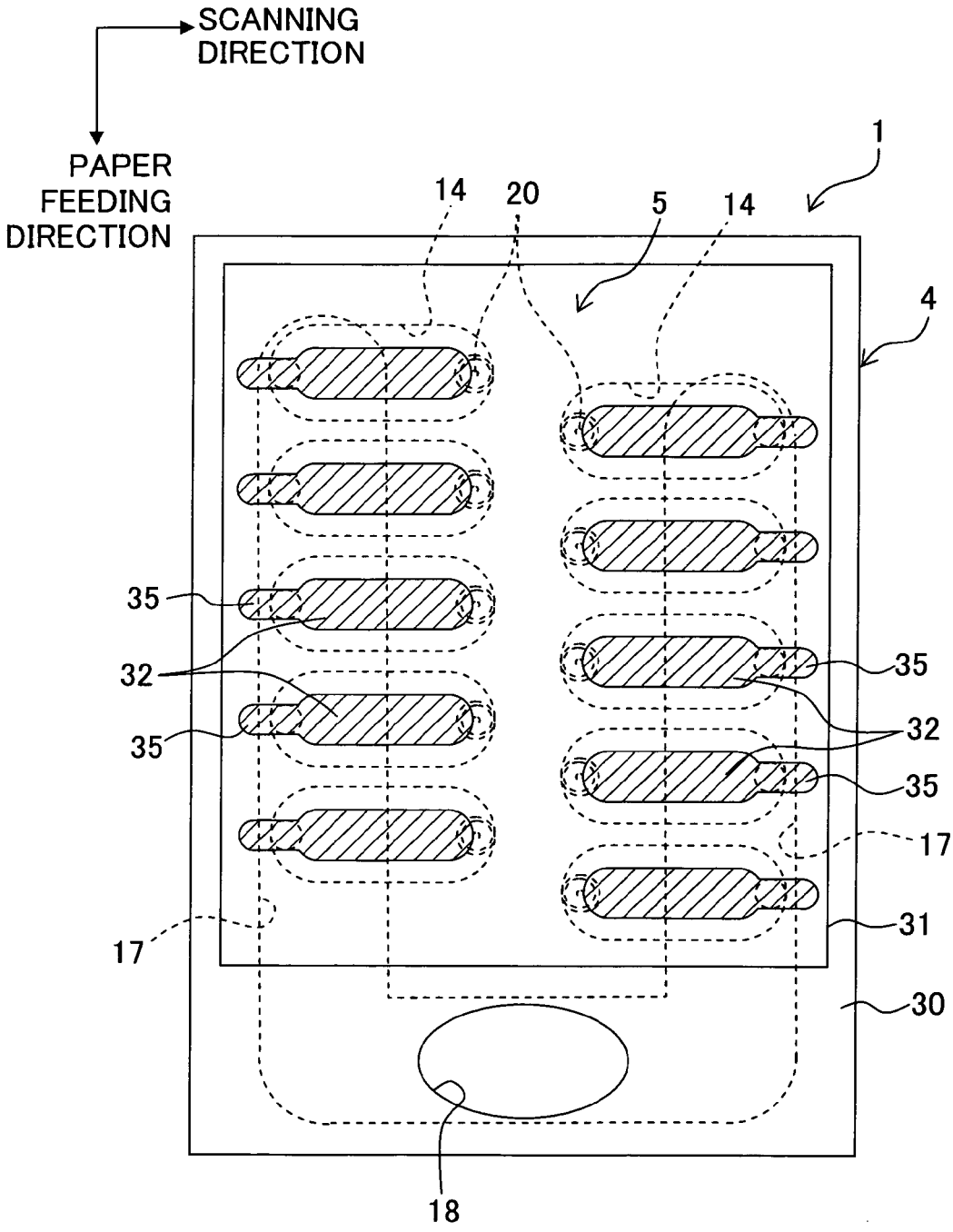
FIG. 9 shows a plan view illustrating an ink-jet head.
Figure 10:
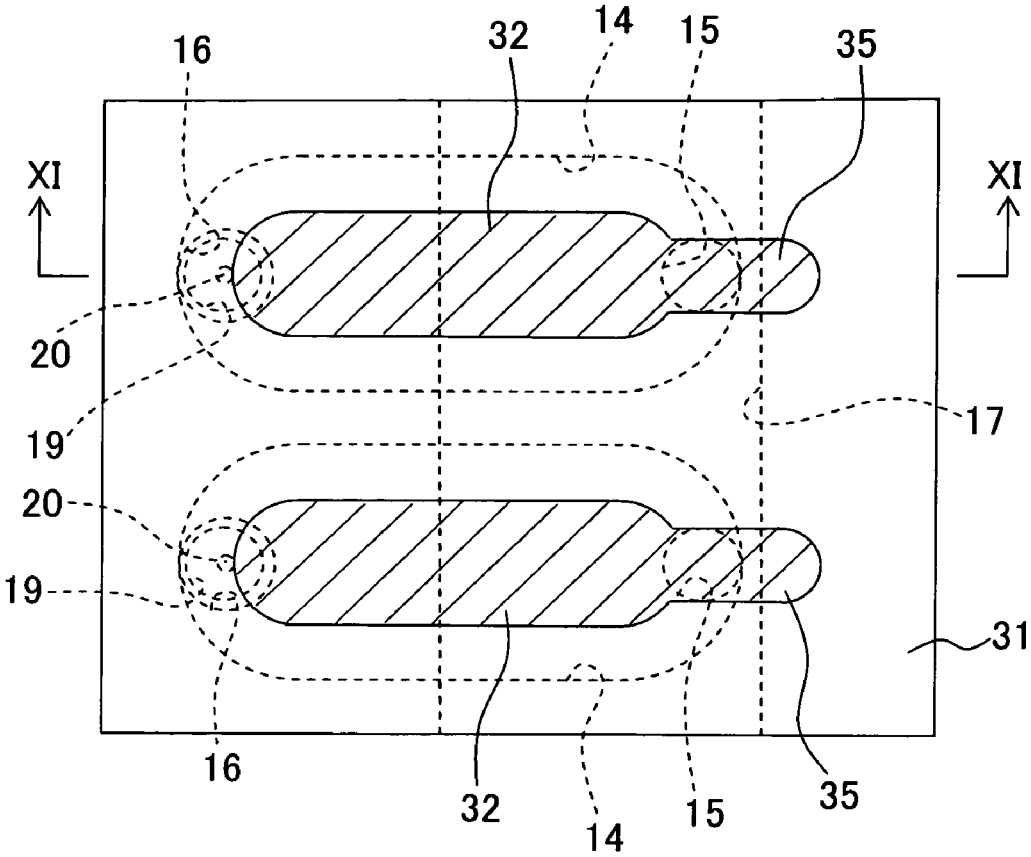
FIG. 10 shows a partial magnified view illustrating those shown in FIG. 9.
Figure 11:
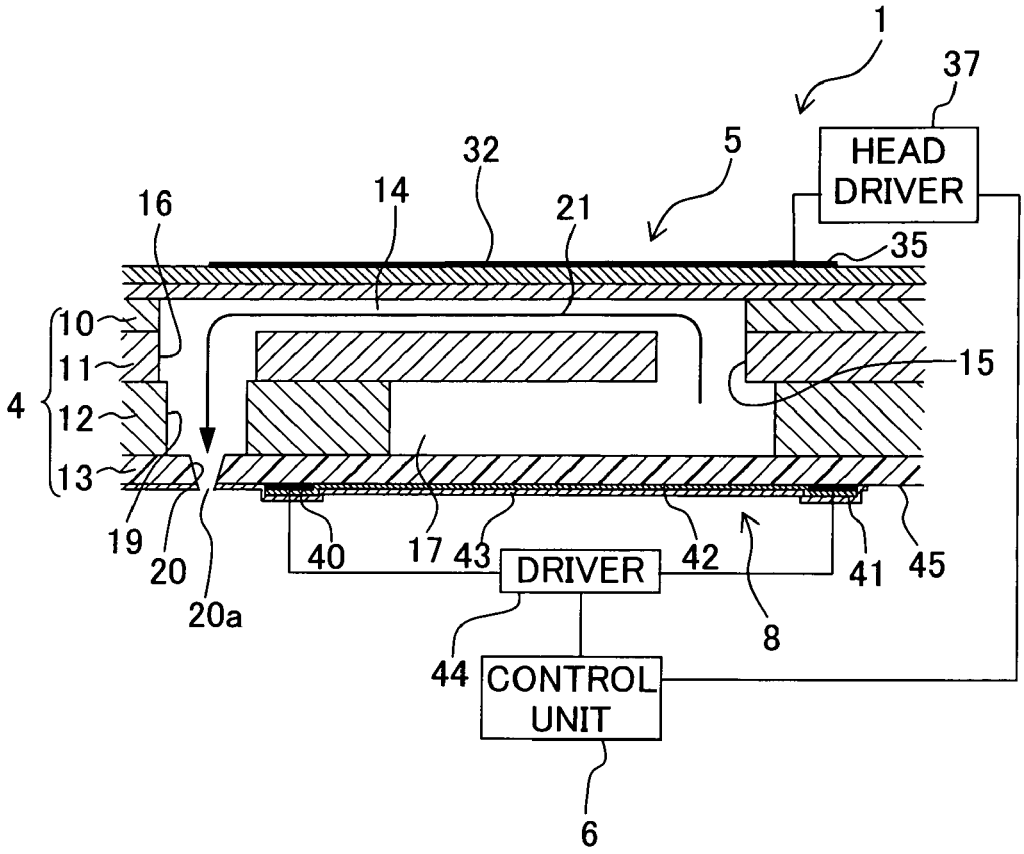
FIG. 11 shows a sectional view taken along a line XI-XI sown in FIG. 10.

FIG. 9 shows a plan view illustrating the ink-jet head, FIG. 10 shows a partial magnified view illustrating those shown in FIG. 9, and FIG. 11 shows a sectional view taken along a line XI-XI shown in FIG. 10. As shown in FIGS. 9 to 11, the ink-jet head 1 comprises a flow passage unit 4 which is formed with ink flow passages including the nozzles 20 and pressure chambers 14, and a piezoelectric actuator 5 which discharges the inks from the nozzles 20 of the flow passage unit 4 by applying the pressure to the inks contained in the pressure chambers 14.

At first, the flow passage unit 4 will be explained. As shown in FIG. 11, the flow passage unit 4 includes a cavity plate 10, a base plate 11, and a manifold plate 12 each of which is formed of a metal material such as stainless steel, and a nozzle plate 13 which is formed of an insulating material (for example, a high molecular weight synthetic resin material such as polyimide). The four plates 10 to 13 are joined in a stacked state.

As shown in FIGS. 9 to 11, a plurality of pressure chambers 14 are formed in the cavity plate 10 which is included in the four plates 10 to 13 and which is positioned at the uppermost position. Each of the pressure chambers 14 is formed to have a substantially elliptic shape which is long in the scanning direction (left-right direction as shown in FIG. 9) as viewed in a plan view. The plurality of pressure chambers 14 are arranged in two arrays in a zigzag form in the paper feeding direction (upward-downward direction as shown in FIG. 9). A piezoelectric actuator 5 is joined to the upper surface of the flow passage unit 4 as described later on, and thus upper portions of the plurality of pressure chambers 14 are covered with the piezoelectric actuator 5. As shown in FIG. 9, an ink supply port 18, which is to be connected to an unillustrated ink tank, is also formed in the cavity plate 10.

As shown in FIGS. 10 and 11, communication holes 15, 16 are formed respectively at positions of the base plate 11 overlapped with the both ends of the pressure chamber 14 as viewed in a plan view. Two manifolds 17, which extend in the paper feeding direction, are formed in the manifold plate 12 so that the two manifolds 17 are overlapped with portions of the pressure chambers 14 arranged in the two arrays disposed on the sides of the communication holes 15 as viewed in a plan view. The two manifolds 17 are communicated with the ink supply port 18 formed in the cavity plate 10. The ink is supplied to the manifolds 17 via the ink supply port 18 from the unillustrated ink tank. A plurality of communication holes 19, which are continued to the plurality of communication holes 16 respectively, are formed at positions of the manifold plate 12 overlapped with the ends of the plurality of pressure chambers 14 disposed on the sides opposite to the manifolds 17 as viewed in plan view.

The plurality of nozzles 20 are formed respectively at positions of the nozzle plate 13 overlapped with the plurality of communication holes 19 as viewed in a plan view. The plurality of nozzles 20 are arranged in two arrays in a zigzag form corresponding to the plurality of pressure chambers 14 respectively. As shown in FIG. 11, a liquid droplet transport apparatus 8, which is inherent in the present invention, is provided on the lower surface of the nozzle plate 13 composed of the synthetic resin material such as polyimide. The liquid droplet transport apparatus 8 transports the liquid droplets adhered to the lower surface of the nozzle plate 13 so that the liquid droplets are moved away from the discharge ports 20*a* of the nozzles 20. The lower surface of the nozzle plate 13 is covered with an insulating layer 43 which is included in the liquid droplet transport apparatus 8. The liquid repellence of the surface of the insulating layer 43 is higher than that of the lower surface of the nozzle plate 13. The liquid droplet transport apparatus 8 will be explained in detail later on.

As shown in FIG. 11, the manifold 17 is communicated with the pressure chamber 14 via the communication hole 15. Further, the pressure chamber 14 is communicated with the nozzle 20 via the communication holes 16, 19. In this way, a plurality of individual ink flow passages 21, which range from the manifolds 17 via the pressure chambers 14 to arrive at the nozzles 20, are formed in the flow passage unit 4.

Next, the piezoelectric actuator 5 will be explained. The piezoelectric actuator 5 includes a vibration plate 30 which is joined to the upper surface of the flow passage unit 4 so that the plurality of pressure chambers 14 are covered therewith, a piezoelectric layer 31 which is arranged on the upper surface of the vibration plate 30, and a plurality of individual electrodes 32 which are formed on the upper surface of the piezoelectric layer 31.

The vibration plate 30 is a metal plate which is composed of, for example, iron-based alloy such as stainless steel, copper-based alloy, nickel-based alloy, or titanium-based alloy. The vibration plate 30 made of metal is always retained at the ground electric potential by the aid of a head driver 37 (see FIG. 11). The piezoelectric layer 31 is composed of a piezoelectric material which contains a main component of lead titanate zirconate (PZT) as a ferroelectric substance and a solid solution of lead titanate and lead zirconate.

The plurality of individual electrodes 32 are arranged respectively in areas of the upper surface of the piezoelectric layer 31 opposed to central portions of the plurality of pressure chambers 14. Contact sections 35 are led from the plurality of individual electrodes 32 respectively. The plurality of individual electrodes 32 are connected to the head driver 37 via unillustrated wiring members joined to the contact sections 35. Any one of the ground electric potential and the predetermined driving electric potential different from the ground electric potential is applied from the head driver 37 to each of the plurality of individual electrodes 32.

An explanation will be made about the function of the piezoelectric actuator 5 during the discharge of the ink. When the liquid droplets of the ink are discharged from a certain nozzle 20, the driving electric potential is applied from the head driver 37 to the individual electrode 32 corresponding to the pressure chamber 14 communicated with the concerning nozzle 20. Accordingly, the difference in the electric potential is generated between the individual electrode 32 to which the driving electric potential is applied and the vibration plate 30 which is retained at the ground electric potential. The electric field, which is parallel to the thickness direction, is generated in the piezoelectric layer 31 which is interposed between the both. In this situation, when the direction of polarization of the piezoelectric layer 31 is the same as the direction of the electric field, then the piezoelectric layer 31 is elongated in the thickness direction, and the piezoelectric layer 31 is shrunk in the in-plane direction. In accordance with the shrinkage deformation of the piezoelectric layer 31, the portion of the vibration plate 30, which is opposed to the pressure chamber 14, is deformed so that the portion protrudes toward the pressure chamber 14 (unimorph deformation). In this situation, the volume of the pressure chamber 14 is decreased. Therefore, the internal pressure of the ink is increased, and the ink is discharged from the nozzle 20 communicated with the pressure chamber 14.

Figure 12:
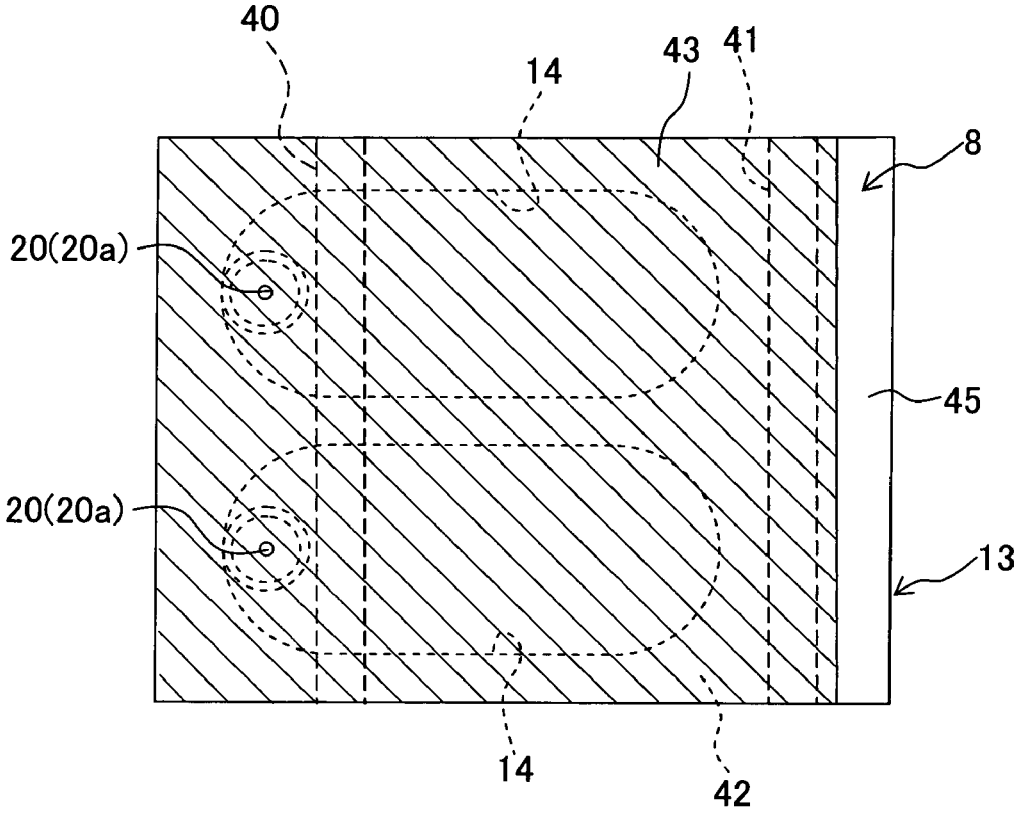
FIG. 12 shows a magnified plan view illustrating a part of the ink-jet head shown in FIG. 9 as viewed from the lower side (side of a nozzle plate).

Next, the liquid droplet transport apparatus 8 provided on the nozzle plate 13 will be explained in detail. FIG. 12 shows a plan view illustrating the ink-jet head 1 as viewed from the lower side (side of the nozzle plate 13).

The liquid droplet transport apparatus 8 transports the liquid droplets in the direction to make separation from the discharge port 20*a* so that the liquid droplet does not interfere with any liquid droplet to be discharged from the nozzle 20 next, when a part of the liquid droplet discharged from the discharge port 20*a* of the nozzle 20 adheres to the surrounding area around the discharge port 20*a* on the lower surface of the nozzle plate 13.

In the case of the conventional ink-jet head, the surface of the nozzle plate is coated with a liquid-repellent film including, for example, a fluorine-based resin. When a part of the liquid droplet discharged from the discharge port adheres to the surface of the liquid-repellent film, the liquid droplet is generally wiped out by means of a wiper. However, in the case of this conventional arrangement, the liquid-repellent film, which covers the nozzle plate, is gradually abraded or worn away, and the surface liquid repellence is progressively lowered by repeating the wiping operation by the wiper over a long period of time. As a result, a problem arises such that it is difficult to remove the liquid droplet disposed around the discharge port.

On the contrary, in the second embodiment, the liquid droplet transport apparatus 8, which does not use the wiper, is adopted so that the liquid repellence of the insulating layer 43 (liquid-repellent film) is not lowered even in the case of the use over a long period of time. The liquid droplet transport apparatus 8 transports the liquid droplet in the direction to make separation from the discharge port 20*a* by utilizing the phenomenon (electrowetting phenomenon) wherein the liquid repellence, which is provided on the surface of the insulating layer 43 in the area to cover the electrode (second electrode 41), is changed depending on the difference in the electric potential between the electrode and the ink.

As shown in FIGS. 11 and 12, the liquid droplet transport apparatus 8 includes a first electrode 40 and a second electrode 41 each of which is arranged on the nozzle plate 13 (substrate) composed of an insulating material (for example, a high molecular weight resin material such as polyimide), a resistor layer 42 which is arranged on the lower surface of the nozzle plate 13 as well and which makes the electric conduction to both of the first electrode 40 and the second electrode 41 to connect the both, the insulating layer 43 which covers the first electrode 40, the second electrode 41, and the resistor layer 42, and a driver 44 (electric potential-applying mechanism) which applies the electric potential to the first electrode 40 and the second electrode 41.

As shown in FIG. 12, the first electrode 40 continuously extends over the plurality of nozzles 20 in the direction of arrangement of the nozzles 20 in the area (surrounding area around the discharge ports 20*a*) disposed in the vicinity of the nozzles 20 arranged in the paper feeding direction (upward-downward direction as shown in FIG. 12). The second electrode 41 continuously extends over the plurality of nozzles 20 in the direction of arrangement of the nozzles 20 in the area separated in one direction (rightward direction as shown in FIG. 12) of the scanning direction from the plurality of discharge ports 20*a* as compared with the first electrode 40. In other words, the first electrode 40 disposed at the positions around the discharge ports 20*a* and the second electrode 41 separated from the discharge ports 20*a* as compared with the first electrode 40 are arranged in parallel to one another while providing the spacing distance in the scanning direction. Further, the both electrodes 40, 41 are provided commonly in relation to the plurality of discharge ports 20*a*. Both of the first electrode 40 and the second electrode 41 are composed of a conductive material including, for example, gold, copper, silver, palladium, platinum, and titanium, and they are formed, for example, by means of the screen printing method, the sputtering method, or the vapor deposition method.

As shown in FIG. 11, the first electrode 40 and the second embodiment 41 are connected to the driver 44. The ground electric potential is always applied to the first electrode 40 from the driver 44. On the other hand, one of the ground electric potential and the predetermined electric potential (transport electric potential) different from the ground electric potential is selectively applied to the second electrode 41 from the driver 44.

The resistor layer 42 is formed of a resistance material which exhibits a certain specific resistance or resistivity. The resistor layer 42 is formed fully or extensively in the area disposed between the first electrode 40 and the second electrode 41 which are arranged in parallel to one another, on the lower surface of the nozzle plate 13. Both ends of the resistor layer 42 in relation to the scanning direction (left-right direction as shown in FIGS. 11 and 12) are overlapped with the first electrode 40 and the second electrode 41 respectively. The resistor layer 42 makes the electric conduction to both of the electrodes 40, 41. The ground electric potential is applied to the first electrode 40 by the driver 44, and the transport electric potential is applied to the second electrode 41 by the driver 44. When the electric potentials of the first electrode 40 and the second electrode 41 are different from each other, the resistor layer 42 acts as an electric resistor. In other words, when the current is allowed to flow through the resistor layer 42, the electric potential drop (generally referred to as "voltage drop" as well) is generated between the both electrodes 40, 41. The electric potential gradient arises in the resistor layer 42.

As for the resistance material to be used for the resistor layer 42 as described above, it is possible to adopt, for example, graphite, carbon, PG/PBN (high purity carbon/pyrolytic boron nitride), aluminum nitride, and tungsten. The resistor layer 42 can be formed by directly adhering or depositing the resistance material as described above onto the nozzle plate 13 by using the film formation method including, for example, the aerosol deposition method, the sputtering method, the vapor deposition method, and the sol-gel method. The resistance value of the resistor layer is higher than that of the metal material for forming the first and second electrodes, and the resistance value of the resistor layer is lower than that of the insulating layer as described later on. For example, the following condition is required. That is, when a voltage of about 20 V is applied between the first and second electrodes, then the electric potential drop is generated in the resistor layer arranged between the both electrodes, and any excessive current is not allowed to flow through the resistor layer.

The insulating layer 43 is formed on the lower surface of the nozzle plate 13 so that the first electrode 40, the second electrode 41, and the resistor layer 42 are completely covered therewith. However, the insulating layer 43 is not formed in the area of the lower surface of the nozzle plate 13 (area disposed on the right side of the second electrode 41 as shown in FIG. 11) separated farther from the discharge ports 20*a* of the nozzles 20 as compared with the second electrode 41. In this area, the nozzle plate 13 is exposed. The insulating layer 43 is formed of a material such as a fluorine-based resin which has sufficiently high liquid repellence, as compared with the base material such as polyimide for constructing the nozzle plate 13. Accordingly, the liquid repellence of the area of the lower surface of the nozzle plate 13 which is not covered with the insulating layer 43 (liquid-attractive area 45, low liquid repellence area) is always lower than the liquid repellence of the area (high liquid repellence area) which is covered with the insulating layer 43. The insulating layer 43 can be formed on the lower surface of the nozzle plate 13, for example, by means of the spin coat method.

The driver 44 always applies the ground electric potential to the first electrode 40 arranged around the discharge ports 20*a* on the basis of the instruction supplied from a liquid droplet removal control section 52 of the control unit 6 as described later on (see FIG. 16), and the driver 44 applies any one of the ground electric potential and the transport electric potential to the second electrode 41. In other words, the driver 44 is capable of switching the first mode (waiting mode) in which the same electric potential (ground electric potential) is applied to the first electrode 40 and the second electrode 41 and the second mode (liquid droplet transport mode) in which the mutually different electric potentials are applied to the first electrode 40 and the second electrode 41.

As described above, the vibration plate 30 of the piezoelectric actuator 5 and the cavity plate 10, the base plate 11, and the manifold plate 12 of the flow passage unit 4 are the plates made of metal. The vibration plate 30 is retained at the ground electric potential by the aid of the head driver 37. Therefore, the three plates 10 to 12, which are joined to the vibration plate 30, are also at the ground electric potential. Further, the ink, which is allowed to flow through the ink flow passages formed in the plates 10 to 12, has the electric potential which is retained approximately at the ground electric potential as well.

When the liquid droplet of the ink having the conductivity is present on the surface of the insulating layer 43, the liquid repellence of the surface of the insulating layer 43 (wetting angle of the liquid droplet with respect to the surface of the insulating layer 43) depends on the electric potential difference between the electric potential of the liquid droplet to make contact with the surface of the insulating layer 43 and the electric potential of the resistor layer 42 or the electrodes 40, 41 to make contact with the back surface. In this arrangement, the larger the electric potential difference is, the more lowered the liquid repellence of the surface of the area of the insulating layer 43 to cover the electrodes 40, 41 and the resistor layer 42 is (electrowetting phenomenon).

Figure 13:
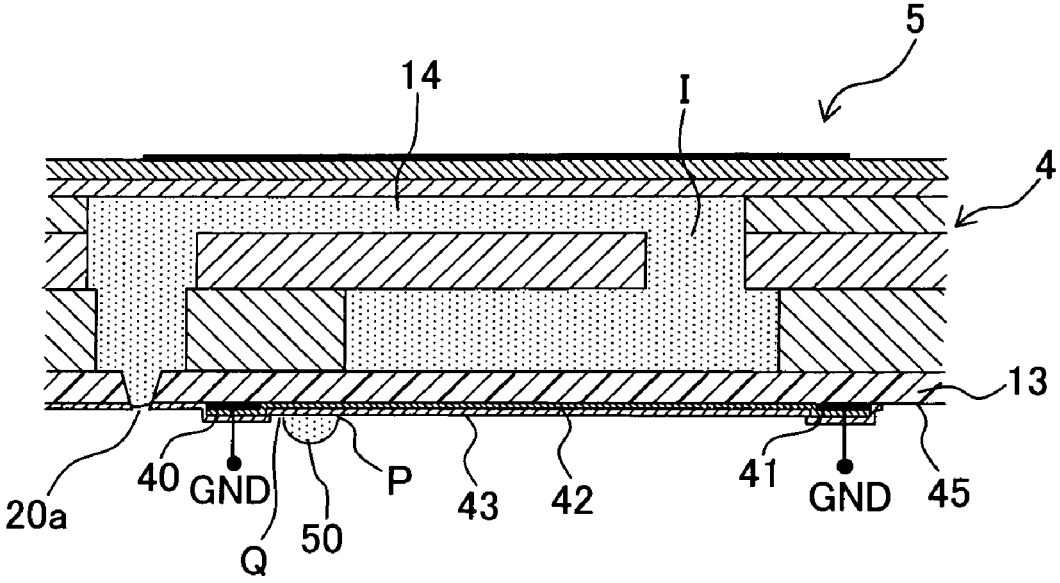
FIG. 13 shows a state brought about immediately before the liquid droplets are transported by a liquid droplet transport apparatus.
Figure 14:
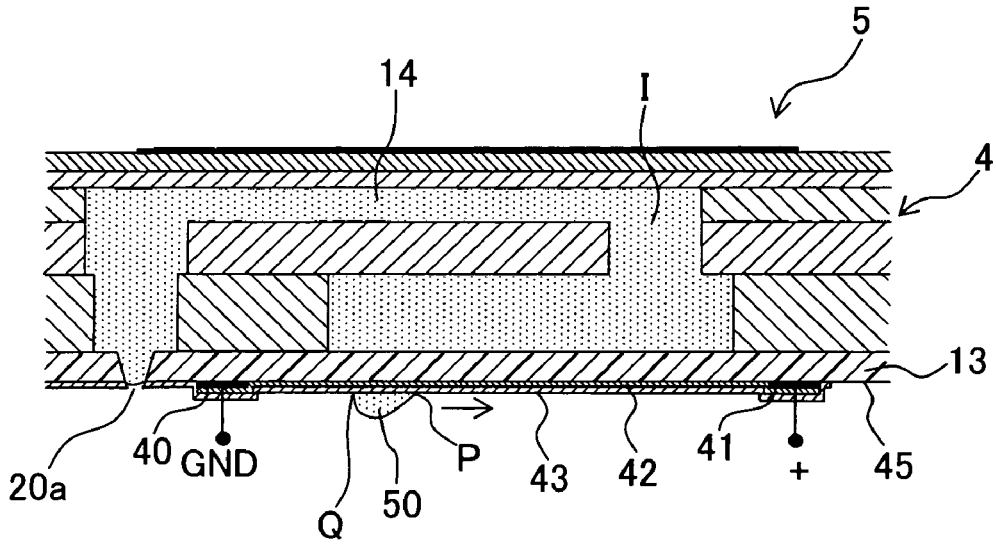
FIG. 14 shows a state brought about during the period in which the liquid droplets are transported by the liquid droplet transport apparatus.
Figure 15:
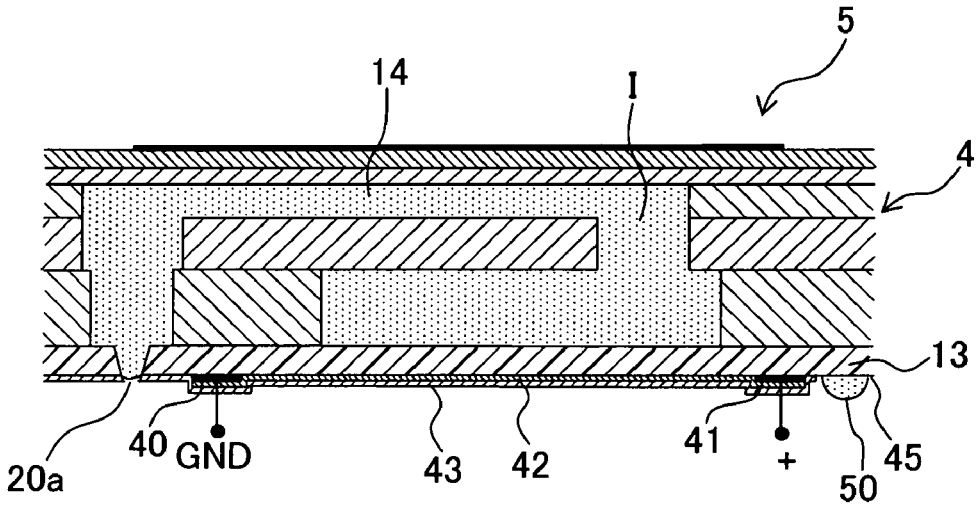
FIG. 15 shows a state brought about when the liquid droplet transport by the liquid droplet transport apparatus is completed.

An explanation will be specifically made with reference to FIGS. 13 to 15 about the behavior of the liquid droplet on the insulating layer 43 as caused by the electrowetting phenomenon. In FIGS. 13 to 15, the symbol "+" indicates a state in which the transport electric potential (for example, +30 V) is applied to the second electrode 41, and the symbol "GND" indicates a state in which the ground electric potential is applied to the first electrode 40 or the second electrode 41. The transport electric potential is the electric potential which is different from the electric potential (ground electric potential) of the ink droplet, for which it is enough that the electric potential difference is generated between the second electrode 41 and the liquid droplet. Therefore, it is not necessarily indispensable that the transport electric potential is the positive electric potential, and the transport electric potential may be the negative electric potential (for example, −30 V).

At first, the first electrode 40 is always retained at the ground electric potential by means of the driver 44. Therefore, the electric potential difference between the first electrode 40 and the ink I is approximately zero. Therefore, the liquid repellence of the surface of the insulating layer 43 is always in a high state in the area which covers the first electrode 40 arranged around the discharge port 20*a*.

In a state in which the driver 44 selects the waiting mode and the ground electric potential is also applied to the second electrode 41 by the driver 44 as shown in FIG. 13, the electric potential of the first electrode 40 is the same as that of the second electrode 41. Therefore, no electric potential gradient arises in the resistor layer 42 provided between the both. The electric potential is the ground electric potential over the entire region of the resistor layer 42. Therefore, the liquid repellence of the surface of the insulating layer 43 is raised in the area to cover the resistor layer 42 and the second electrode 41 as well. In other words, the liquid repellence of the insulating layer 43 is in a uniform state over the entire region. Therefore, even when a part of the liquid droplet of the ink I discharged from the discharge port 20*a* adheres to the surface of the insulating layer 43 of the area to cover the first electrode 40 disposed closely to the discharge port 20*a*, the liquid droplet 50 is not moved to the surroundings.

On the other hand, when the driver 44 selects the liquid droplet transport mode, and the transport electric potential is applied to the second electrode 41 by the driver 44 as shown in FIG. 14, then the electric potentials of the first electrode 40 and the second electrode 41 are different from each other. Therefore, the electric potential gradient arises in the resistor layer 42 provided between the both. The first electrode 40 and the second electrode 41 extend in parallel to one another in the direction of arrangement of the nozzles 20 (in the direction perpendicular to the plane of the paper of FIG. 14). Therefore, the equipotential lines, which are provided in the resistor layer 42 disposed therebetween, are parallel to the extending direction of the electrodes 40, 41. In this situation, the electric potential gradient is generated in the direction (left-right direction as viewed in FIG. 14) perpendicular to the equipotential lines.

Accordingly, the electric potential difference between the resistor layer 42 in which the electric potential gradient is generated and the liquid droplet 50 which is at the ground electric potential is increased at positions disposed nearer to the second electrode 41. Therefore, the liquid repellence of the surface of the insulating layer 43 in the area to cover the resistor layer 42 is lowered at positions disposed nearer to the second electrode 41.

For example, it is assumed that the wetting angle of the liquid droplet 50 with respect to the surface of the insulating layer 43 is about 110° in the area to cover the first electrode 40 to which the ground electric potential is applied, while the wetting angle is lowered to about 65° in the area to cover the second electrode 41 to which the transport electric potential is applied. In this case, the wetting angle of the surface of the insulating layer is gradually lowered from 110° to 65° in the area to cover the resistor layer 42 disposed between the both electrodes 40, 41. Therefore, when a part of the liquid droplet discharged from the discharge port 20*a* adheres to the surface of the insulating layer 43 of the area to cover the first electrode 40 disposed near to the discharge port 20*a*, the liquid droplet 50 is transported to make separation from the discharge port 20*a* along the resistor layer 42 as shown in FIGS. 13 and 14, for the following reason. That is, the wetting angle is decreased at the contact portion P to make contact with the insulating layer 43 disposed on the side of the electrode 41 as compared with the contact portion Q to make contact with the insulating layer 43 disposed on the side of the electrode 40. Therefore, the liquid droplet 50 is moved toward the second electrode 41 as the area in which the liquid repellence is low (wetting angle is low).

The liquid-attractive area 45 (for example, the area having a wetting angle of 55°), in which the liquid repellence is always lower than that of the surface of the insulating layer 43, is provided in the surrounding area around the second electrode 41 on the lower surface of the nozzle plate 13. Therefore, as shown in FIG. 15, the liquid droplet 50, which has been transported to the second electrode 41 on the insulating layer 43, is further moved from the insulating layer 43 to the liquid-attractive area 45. The liquid droplet 50, which has been once moved to the liquid-attractive area 45, is not returned to the surface of the insulating layer 43 which has the higher liquid repellence.

As described above, when the mutually different electric potentials are applied to the first electrode 40 and the second electrode 41, the electric potential gradient is generated in the resistor layer 42. Therefore, the liquid repellence is gradually lowered in the insulating layer 43 in the area disposed between the first electrode 40 and the second electrode 41 to cover the resistor layer 42 therewith in the direction directed toward the second electrode 41. Therefore, even when the distance between the first electrode 40 as the transport departure and the second electrode 41 as the transport destination (transport distance of the liquid droplet 50) is relatively long, then it is unnecessary to arrange any intermediate electrode for transporting the liquid droplet 50 between the electrodes 40, 41, and it is also unnecessary to diligently switch the electric potential of the intermediate electrode. Therefore, it is possible to simplify the arrangement to transport the liquid droplet 50.

The resistor layer 42 is arranged in the area disposed between the first electrode 40 and the second electrode 41 on the lower surface of the nozzle plate 13. Therefore, the liquid droplet 50 can be transported in the shortest distance (linearly in the scanning direction) between the first electrode 40 and the second electrode 41, the liquid droplet 50 being adhered to the surroundings of the discharge port 20*a*. The liquid droplet 50 can be quickly moved away from the discharge port 20*a*.

The first electrode 40 and the second electrode 41 extend in parallel to one another in the direction of arrangement of the nozzles 20. Therefore, the electric potential gradient is generated in the resistor layer 42 arranged between the first electrode 40 and the second electrode 41, in the direction perpendicular to the extending direction of the first electrode 40 and the second electrode 41. Therefore, the liquid droplet 50 can be always transported in the identical direction (in the direction perpendicular to the extending direction of the electrodes 40, 41) irrelevant to the position of adhesion of the liquid droplet 50 on the lower surface of the nozzle plate 13. Therefore, the liquid droplets 50, which are transported from various positions of the nozzle plate 13, can be collectively recovered at one end of the ink-jet head 1. Further, all of a plurality of liquid droplets 50, which are adhered to the surrounding areas of the plurality of discharge ports 20*a* of the nozzle plate 13 respectively, can be transported in the same direction to recover them at once.

Figure 16:
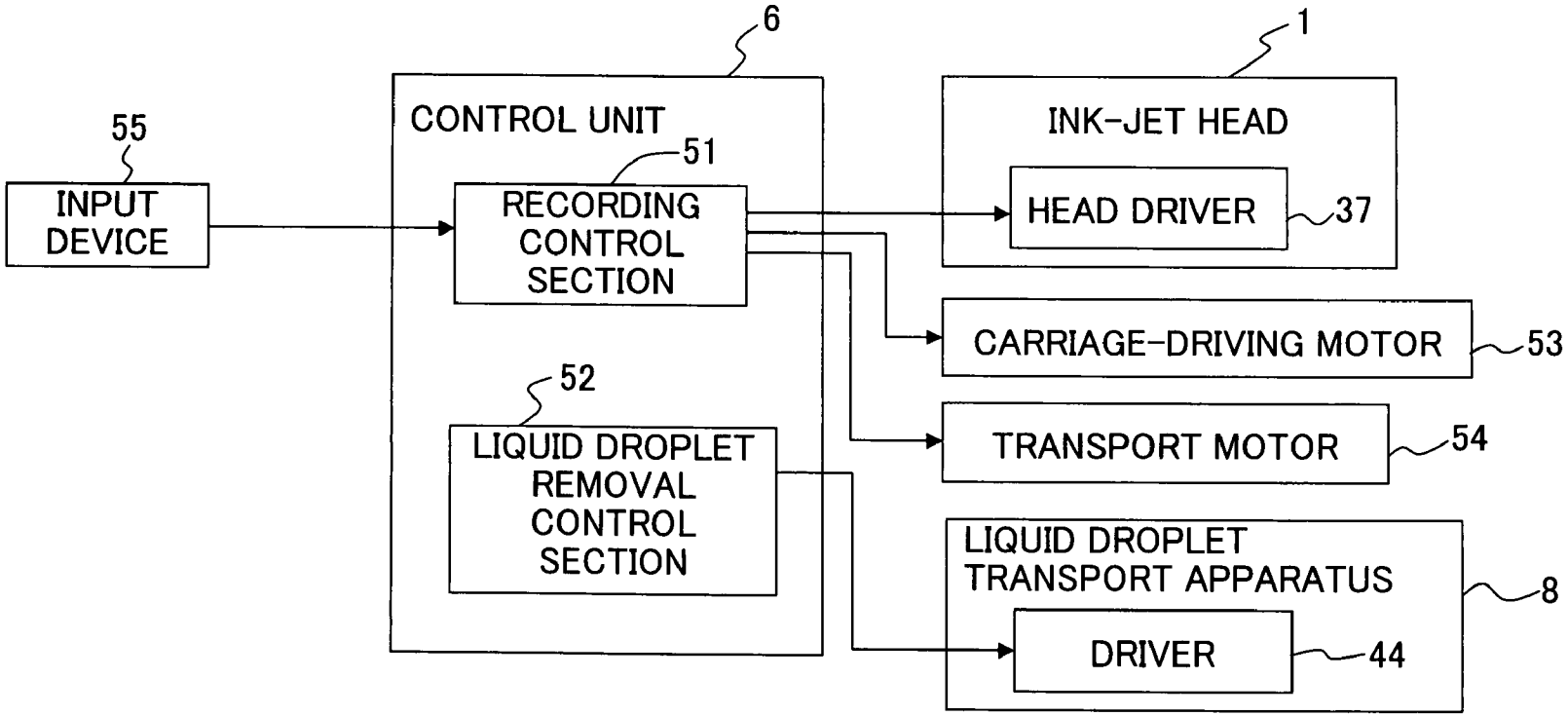
FIG. 16 shows a block diagram illustrating an electric arrangement of the ink-jet printer of the second embodiment.

Next, an explanation will be made about the control unit 6 which manages the overall control of the printer 100. FIG. 16 shows a block diagram illustrating the electric arrangement of the printer 100. The control unit 6 shown in FIG. 16 comprises, for example, a central processing unit (CPU), a read only memory (ROM) which stores, for example, various programs and data for controlling the overall operation of the printer 100, and a random access memory (RAM) which temporarily stores, for example, the data to be processed by CPU.

The control unit 6 further comprises a recording control section 51 and a liquid droplet removal control section 52.

The recording control section 51 controls, for example, a carriage-driving motor 53 which reciprocatively drives the carriage 2 (see FIG. 8), the head driver 37 of the ink-jet head 1, and a transport motor 54 which drives and rotates the transport roller 3 (see FIG. 8) on the basis of the data inputted from an input device 55 such as PC so that the image or the like is recorded on the recording paper P1.

The liquid droplet removal control section 52 controls the liquid droplet transport apparatus 8 so that liquid droplets of the ink adhered to the surroundings of the discharge ports 20*a* of the ink-jet head 1 are removed. More specifically, when the ink discharge operation is not performed by the ink-jet head 1, then any liquid droplet is not adhered to the surroundings of the discharge ports 20*a* of the nozzle plate 13, and it is unnecessary to remove the liquid droplet. In this situation, the liquid droplet removal control section 52 allows the driver 44 of the liquid droplet transport apparatus 8 to select the waiting mode, and the same electric potential (ground electric potential) is applied to the first electrode 40 and the second electrode 41.

On the other hand, when the ink discharge operation is performed by the ink-jet head 1, it is assumed that the liquid droplets of the ink I are adhered to some extent to the surroundings of the discharge ports 20*a* of the nozzle plate 13. In this situation, the driver 44 is allowed to select the liquid droplet transport mode, and the transport electric potential is applied to the second electrode 41 as shown in FIG. 14. Accordingly, the liquid droplets 50 are transported along the resistor layer 42 in the direction directed from the first electrode 40 which is arranged in the surrounding area around the discharge ports 20*a* to the second electrode 41 which is disposed separately from the discharge ports 20*a* on the surface of the insulating layer 43.

In this way, the driver 44 selects the liquid droplet transport mode to apply the mutually different electric potentials to the two electrodes 40, 41 respectively only when the liquid droplets 50 are required to be transported. On the other hand, when it is unnecessary to transport the liquid droplets, then the waiting mode is provided to allow the two electrodes 40, 41 to have the same electric potential. In this way, no current flows through the resistor layer 42 in the waiting mode. Therefore, it is possible to reduce the electric power consumption.

As described above, the liquid-attractive area 45, which is not covered with the insulating layer 43, is provided in the surrounding area around the second electrode 41 on the lower surface of the nozzle plate 13. Therefore, as shown in FIG. 15, the liquid droplet 50, which has been transported to the area to cover the second electrode 41, is further moved to the liquid-attractive area 45. Further, the liquid droplet 50 is not returned from the liquid-attractive area 45 to the surface of the insulating layer 43. Therefore, after the liquid droplet transport mode is selected to transport the liquid droplet 50 to the liquid-attractive area 45, the mode is returned to the waiting mode, and it is possible to allow the electric potential of the second electrode 41 to be the same as the electric potential of the first electrode 40. In other words, when the liquid droplet is not transported, it is possible to provide such a state that no current flows through the resistor layer 42. It is possible to suppress the electric power consumption.

As explained above, in the liquid droplet transport apparatus 8 of the second embodiment, the first electrode 40 which is arranged around the discharge port 20*a* on the lower surface of the nozzle plate 13 and the second electrode 41 which is arranged at the position separated from the discharge port 20*a* as compared with the first electrode 40 are connected to one another by means of the resistor layer 42. Therefore, even when the distance (transport distance of the liquid droplet) is relatively long between the first electrode 40 and the second electrode 41, then it is unnecessary to arrange a large number of intermediate electrodes for transporting the liquid droplet between the electrodes 40, 41, and it is unnecessary to diligently switch the electric potentials of the intermediate electrodes. Therefore, it is possible to decrease the number of electrodes, and the electric potential control for the electrodes is simplified as well. Therefore, it is possible to simplify the arrangement required for the liquid droplet transport.

Next, an explanation will be made about modified embodiments in which various modifications are applied to the second embodiment described above. However, the parts or components, which are constructed in the same manner as in the second embodiment described above, are designated by the same reference numerals, any explanation of which will be appropriately omitted.

Third Modified Embodiment

Figure 17:
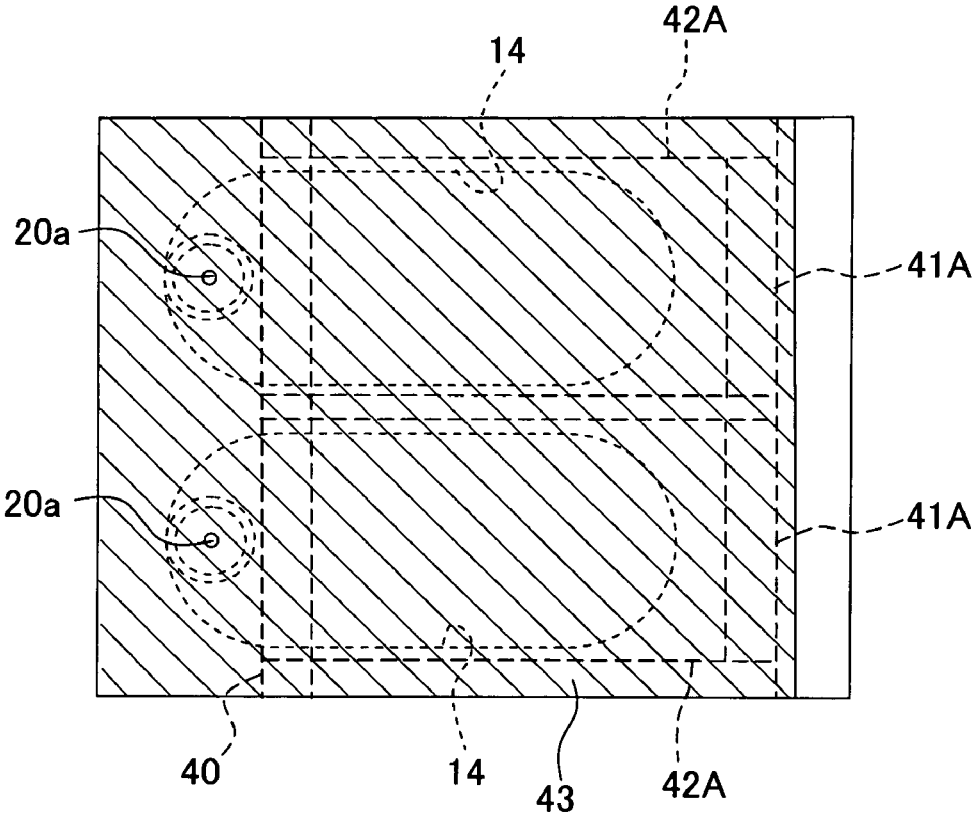
FIG. 17 shows a magnified plan view illustrating a part of an ink-jet head according to a third modified embodiment as viewed from the lower side.

In the second embodiment described above, the second electrode 41, to which the transport electric potential is applied by the driver 44, is provided commonly for the plurality of discharge ports 20*a* of the nozzles 20 (see FIG. 12). However, as shown in FIG. 17, it is also appropriate that a plurality of second electrodes 41A, which correspond to the plurality of discharge ports 20*a* respectively, are provided independently. In this case, the transport electric potential can be applied from the driver 44 to only the second electrode 41A corresponding to the discharge port 20*a* for which the removal of the liquid droplet is considered to be necessary. Accordingly, the current, which is allowed to flow through the resistor layer 42, is maximally suppressed, and it is possible to reduce the electric power consumption. In this arrangement, the discharge port 20*a*, for which the removal of the liquid droplet is considered to be necessary, refers to, for example, the discharge port from which the liquid droplets have been discharged immediately before and it is postulated that the liquid droplets may be adhered to the surroundings thereof.

Further, in the third modified embodiment, as shown in FIG. 17, the resistor layers 42A are provided in a divided form corresponding to the plurality of second electrodes 41A. Therefore, the liquid droplet, which is adhered to the surrounding of a certain discharge port 20*a*, is prevented from being transported toward the second electrode 41A corresponding to the adjoining discharge port 20*a*.

Fourth Modified Embodiment

Figure 18:
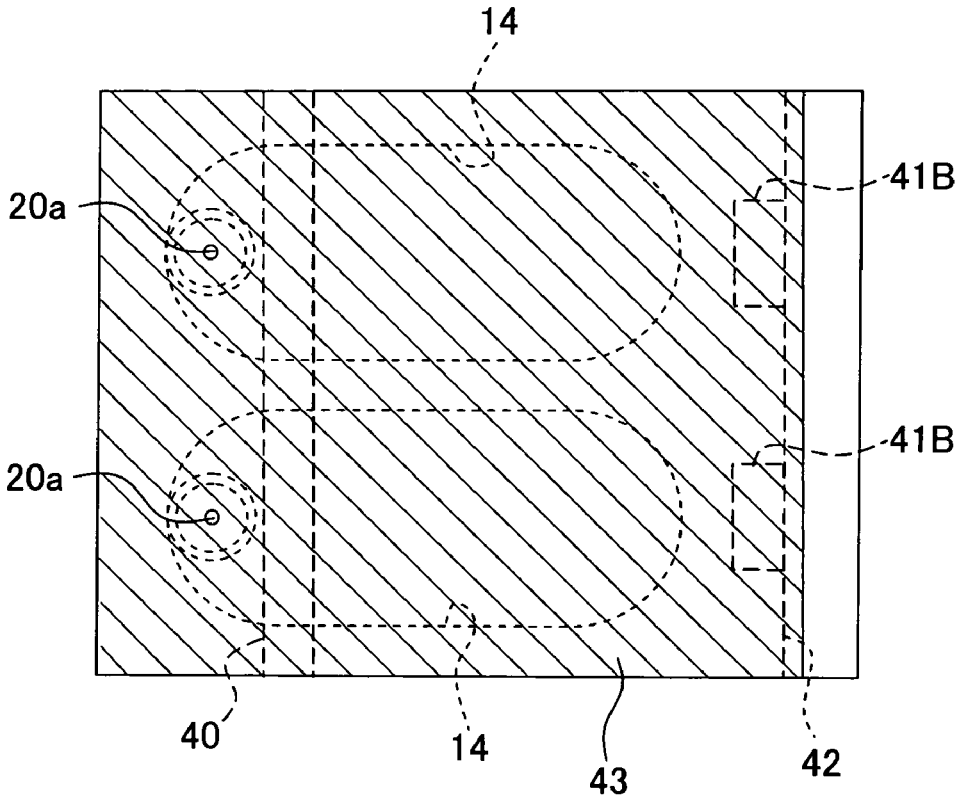
FIG. 18 shows a magnified plan view illustrating a part of an ink-jet head according to a fourth modified embodiment as viewed from the lower side.

As shown in FIG. 18, it is also appropriate that a plurality of second electrodes 41B are provided for the plurality of discharge ports 20*a* respectively, and the resistor layer 42 is provided commonly for the plurality of discharge ports 20*a* (the plurality of second electrodes 41B) in the same manner as in the second embodiment described above. In this arrangement, it is easy to form the resistor layer 42 as compared with the arrangement in which the resistor layer 42 is divided as shown in FIG. 17. As shown in FIG. 18, it is also appropriate that the length of the second electrode 41B is somewhat shorter than that of the embodiment shown in FIG. 17. Also in this arrangement, the liquid droplet, which is adhered to the surrounding of a certain discharge port 20*a*, can be prevented from being transported toward the second electrode 41 corresponding to the adjoining discharge port 20*a* via the commonly provided resistor layer 42.

Fifth Modified Embodiment

When the transport distance of the liquid droplet is considerably long on the lower surface of the nozzle plate 13, it is difficult to transport the liquid droplet, because the electric potential gradient of the resistor layer 42 (i.e., the ratio of change of the liquid repellence (wetting angle) of the insulating layer 43) cannot be increased sufficiently, unless the electric potential difference is considerably increased between the first electrode 40 and the second electrode 41. Accordingly, in such a situation, it is preferable that a plurality of second electrodes 41 are provided and aligned while providing appropriate intervals on the lower surface of the nozzle plate 13, and the mutually adjoining second electrodes 41 are electrically connected to one another via the resistor layer 42. In this arrangement, it is possible to secure the electric potential gradient of the resistor layer 42 required to transport the liquid droplet without increasing the transport electric potential so much.

Figure 19:
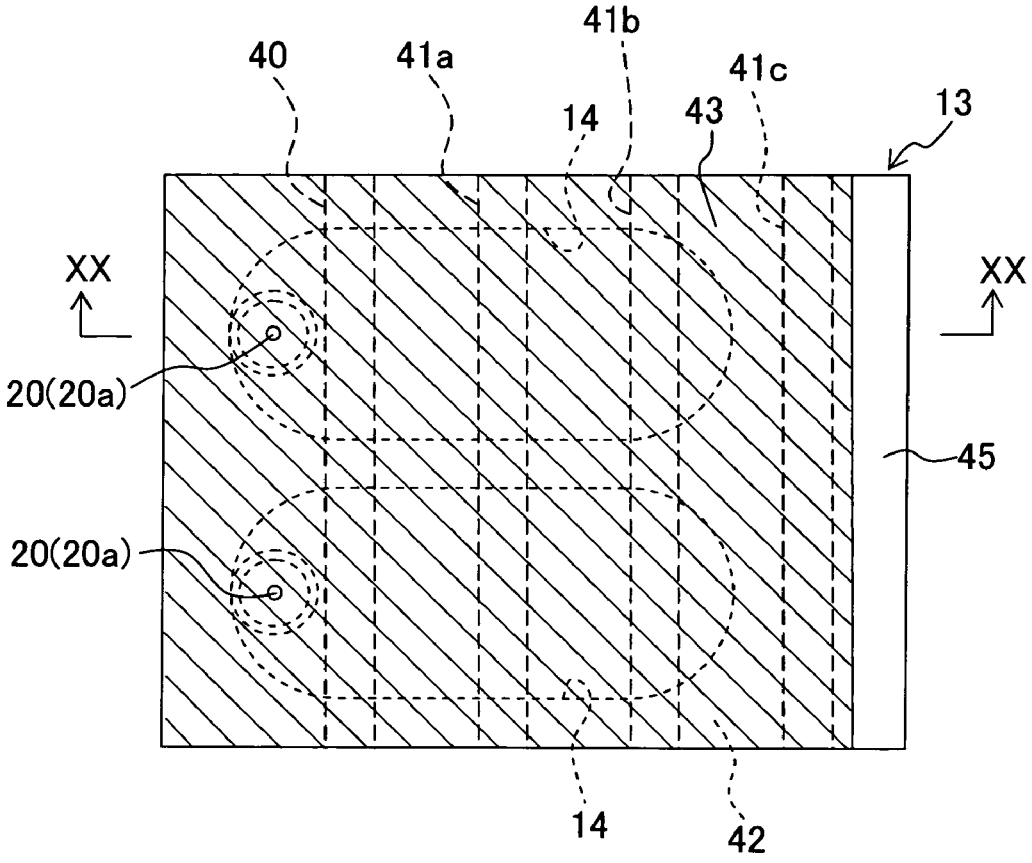
FIG. 19 shows a magnified plan view illustrating a part of an ink-jet head according to a fifth modified embodiment as viewed from the lower side.
Figure 20:
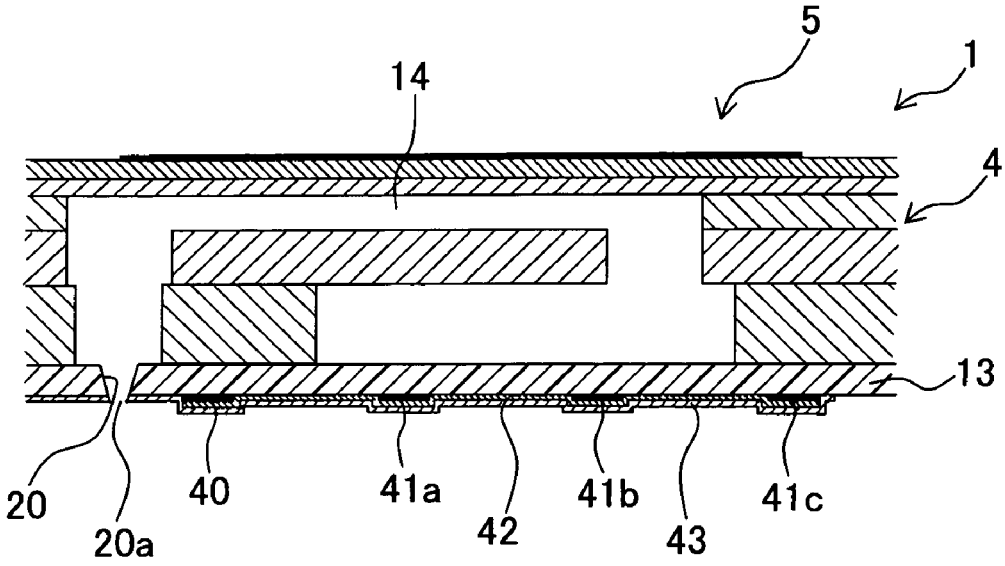
FIG. 20 shows a sectional view taken along a line XX-XX shown in FIG. 19.

An example of the fifth modified embodiment is shown in FIGS. 19 and 20. As shown in FIGS. 19 and 20, two second electrodes 41*a*, 41*b* are further provided between the first electrode 40 which is arranged around the discharge ports 20*a* and a second electrode 41*c* which is the final transport destination. The four electrodes (first electrode 40 and three second electrodes 41*a* to 41*c*) are arranged at equal intervals in relation to the scanning direction (left-right direction as viewed in FIGS. 19 and 20) perpendicular to the direction of arrangement of the nozzles 20. The four electrodes 40, 41*a* to 41*c* are connected to the adjoining electrodes via the resistor layer 42 respectively. Further, the four electrodes 40, 41*a* to 41*c* and the resistor layer 42 are covered with the common insulating layer 43.

Figure 21:
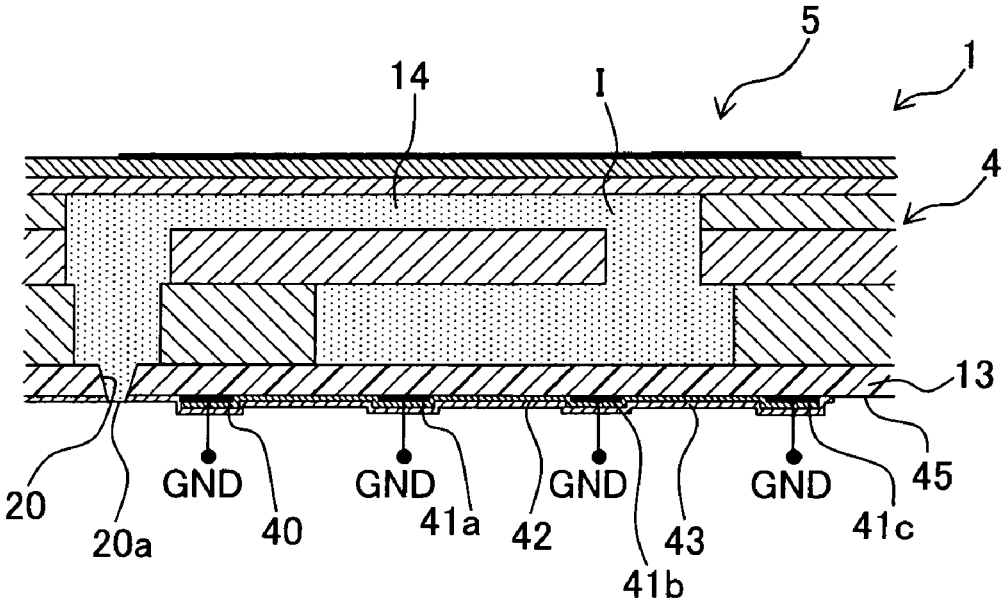
FIG. 21 shows a waiting state in which the liquid droplet transport is not performed by a liquid droplet transport apparatus of the fifth modified embodiment.

The function of the liquid droplet transport apparatus of the fifth modified embodiment will be explained with reference to FIGS. 21 to 25. As shown in FIG. 21, when the liquid droplet is not discharged by the ink-jet head 1, then the driver 44 selects the waiting mode on the basis of the instruction supplied from the control unit 6, and all of the first electrode 40 and the three second electrodes 41 are retained at the ground electric potential by the driver 44.

Figure 22:
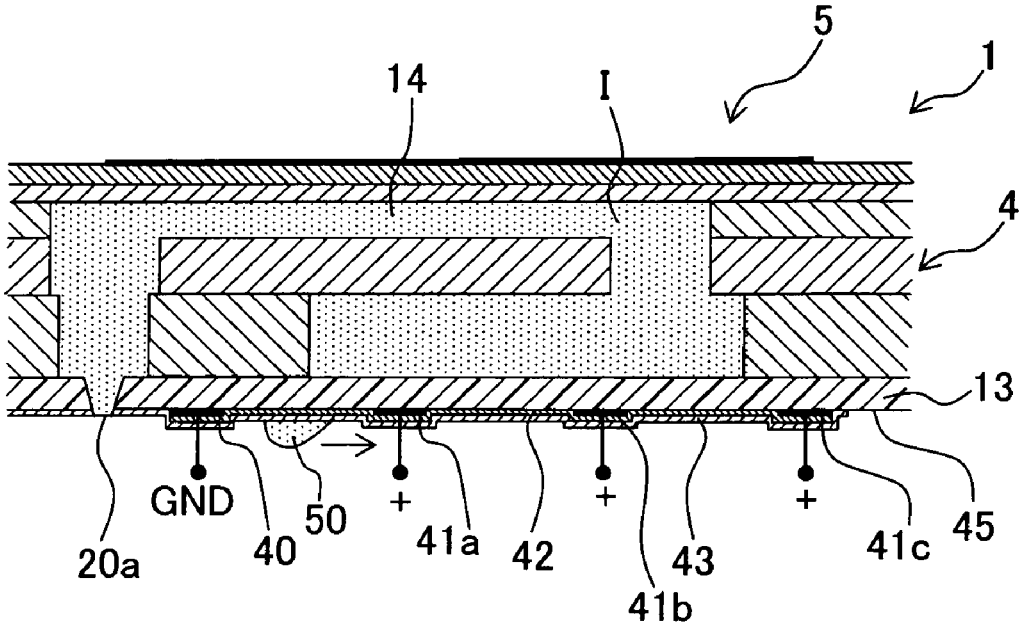
FIG. 22 shows a state brought about immediately after the liquid droplet transport is started by the liquid droplet transport apparatus.

Starting from this state, when the liquid droplet of the ink I is discharged by the ink-jet head 1, the instruction is inputted from the control unit 6 to the driver 44 to switch the mode from the waiting mode to the liquid droplet transport mode. Accordingly, as shown in FIG. 22, the driver 44 firstly switches the electric potentials of the three second electrodes 41*a* to 41*c* from the ground electric potential to the transport electric potential (for example, 30 V). Accordingly, the electric potential gradient is generated in the resistor layer 42 disposed between the first electrode 40 to which the ground electric potential is applied and the second electrode 41*a* which is disposed at the position nearest to the discharge port 20*a*. Therefore, the liquid droplet 50, which is adhered to the surface of the insulating layer 43, is transported from the first electrode 40 toward the second electrode 41*a*.

Figure 23:
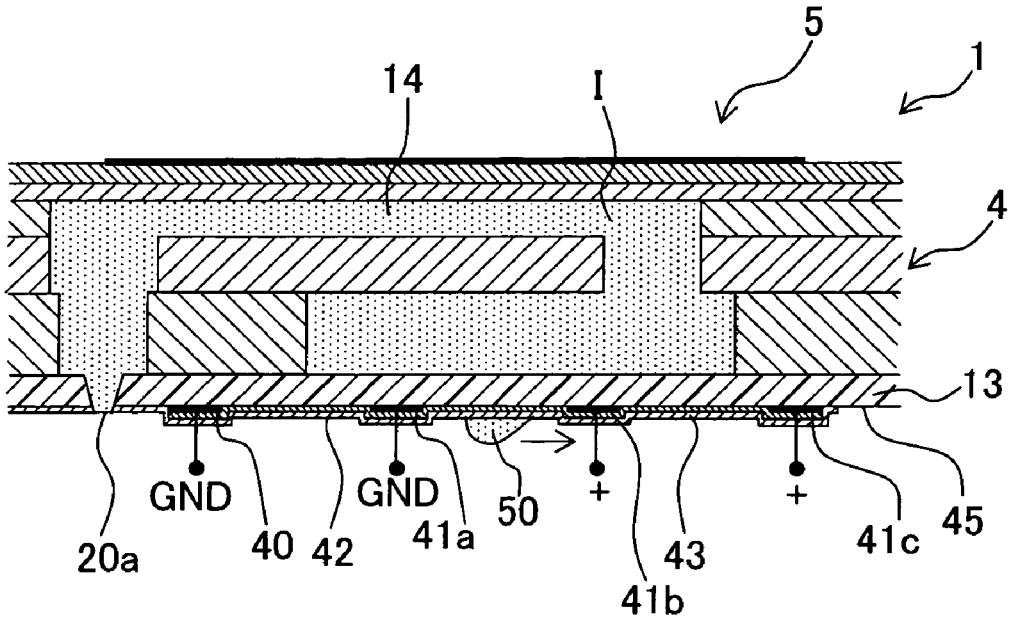
FIG. 23 shows a state brought about during the period in which the liquid droplet transport is performed by the liquid droplet transport apparatus.

When a predetermined period of time elapses after the application of the transport electric potential to the second electrode 41*a*, and the liquid droplet 50 is transported to the second electrode 41*a* disposed nearest to the discharge port 20*a*, then the driver 44 switches only the electric potential of the second electrode 41*a* to the ground electric potential as shown in FIG. 23. In this situation, the electric potentials of the remaining second electrodes 41*b*, 41*c* are still the transport electric potential. Accordingly, the electric potential gradient is generated in the resistor layer 42 disposed between the adjoining two second electrodes 41*a*, 41*b*. Therefore, the liquid droplet 50 is transported from the electrode 41*a* toward the electrode 41*b*.

Figure 24:
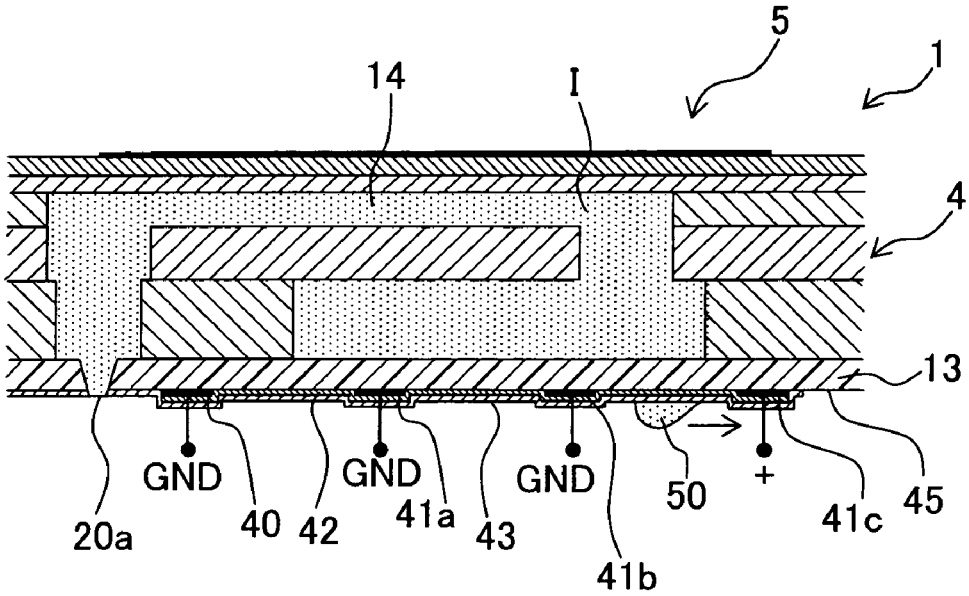
FIG. 24 shows a state brought about immediately before the liquid droplet transport by the liquid droplet transport apparatus is completed.
Figure 25:
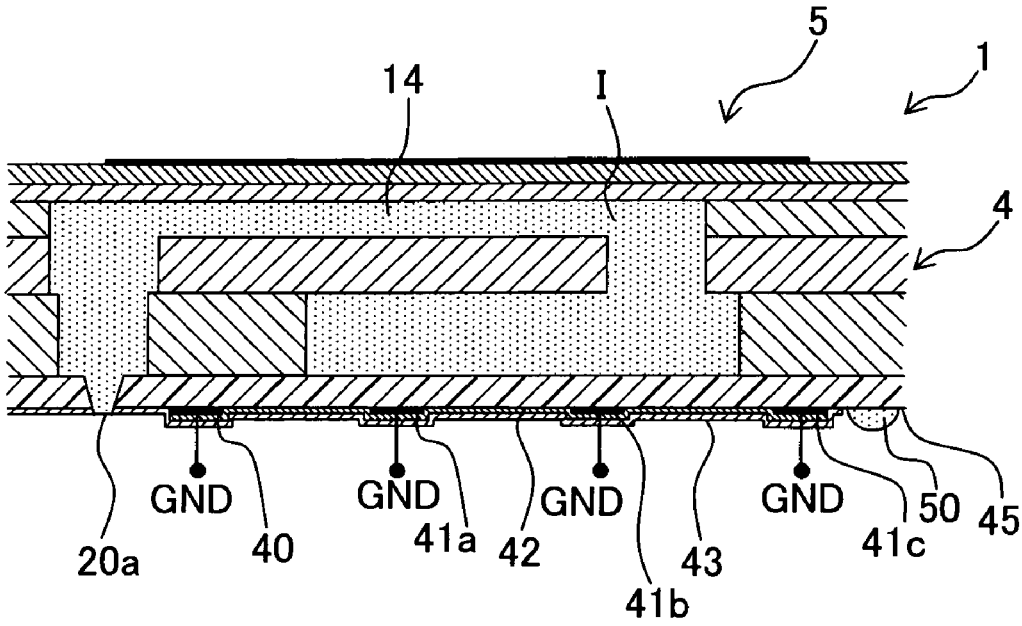
FIG. 25 shows a state brought about when the liquid droplet transport by the liquid droplet transport apparatus is completed.

Further, as shown in FIG. 24, when a predetermined period of time elapses after the switching of the electric potential of the second electrode 41*a*, and the liquid droplet 50 is transported to the second electrode 41*b*, then the driver 44 switches the electric potential of the second electrode 41*b* positioned at the middle to the ground electric potential. Accordingly, the liquid droplet 50 is transported toward the second electrode 41*c* disposed at the position separated farthest from the discharge port 20*a*. Further, as shown in FIG. 25, the liquid droplet 50 arrives at the second electrode 41*c*, and then the liquid droplet 50 is moved to the liquid-attractive area 45 in which the liquid repellence is always lower than that of the surface of the insulating layer 42. After that, the driver 44 switches the electric potential of the second electrode 41*c* to the ground electric potential to return to the waiting mode in which the ground electric potential is applied to all of the electrodes (first electrode 40 and three second electrodes 41*a* to 41*c*).

In FIGS. 22 and 23 to show the state during the liquid droplet transport, the driver 44 applies the transport electric potential to not only the second electrode 41 which is disposed nearest to the liquid droplet 50 but also to the second electrode 41 which is disposed on the downstream side in the transport direction as compared with the second electrode 41 disposed nearest to the liquid droplet 50. However, the following procedure is also available. That is, the transport electric potential is applied to only the second electrode 41 which is disposed nearest to the liquid droplet 50. The electric potential of the second electrode 41 positioned on the downstream side is switched from the ground electric potential to the transport electric potential for the first time when the liquid droplet 50 arrives at the second electrode 41 to which the transport electric potential is applied.

As described above, the plurality of second electrodes 41*a* to 41*c* are arranged and aligned while providing the intervals between the area as the liquid droplet transport departure (surrounding area around the discharge port 20*a*) and the area as the transport destination (liquid-attractive area 45). The adjoining second electrodes 41 are connected to one another by the resistor layer 42. Therefore, even when the liquid droplet transport distance is long, it is possible to shorten the distance between the adjoining electrodes. Therefore, when the electric potentials of the plurality of second electrodes 41 are switched depending on the position of the liquid droplet 50, then the electric potential gradient, which is generated in the resistor layer 42, can be increased to such an extent that the electric potential gradient is required for the liquid droplet transport, and the liquid droplet can be transported over a longer distance.

Sixth Modified Embodiment

Figure 26:
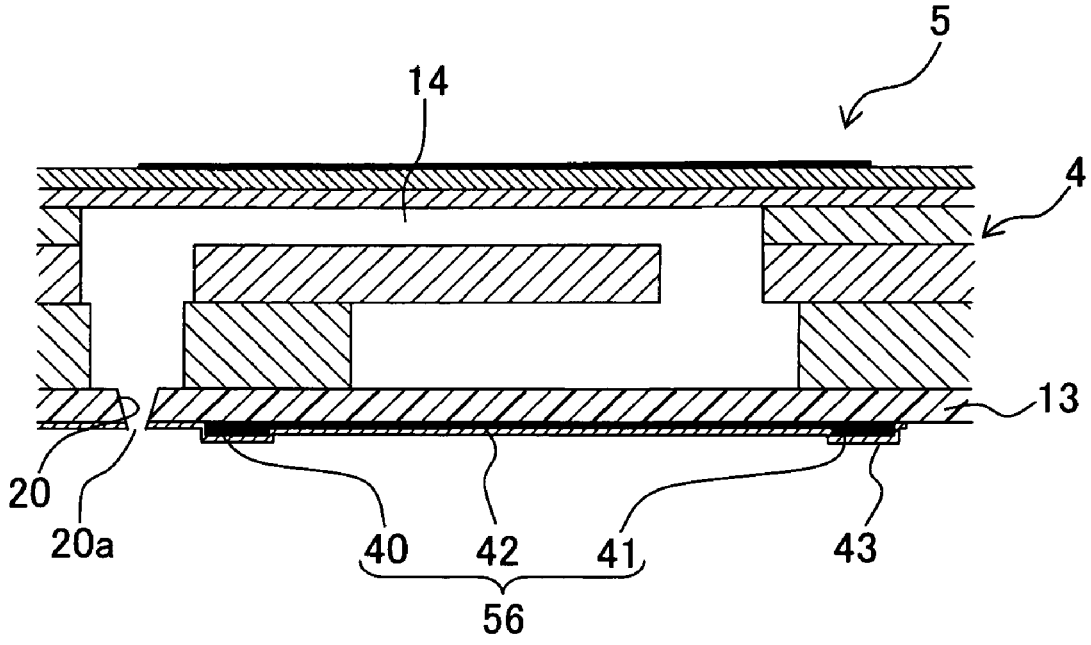
FIG. 26 shows a sectional view illustrating an ink-jet head of a sixth modified embodiment corresponding to FIG. 11.

In the second embodiment described above, the first electrode 40, the second electrode 41, and the resistor layer 42 are formed of the distinct conductive materials. However, it is also possible to form them of the same conductive material. That is, as shown in FIG. 26, a conductive layer 56 is formed of one type of conductive material on the lower surface of the nozzle plate 13 so that the thickness of the central portion in relation to the liquid droplet transport direction (left-right direction as viewed in FIG. 26) is smaller than the thicknesses of the both ends. Such a conductive layer 56 can be formed, for example, by means of the following method. At first, a conductive layer, which has a uniform thickness, is formed on the lower surface of the nozzle plate 13 by means of the sputtering method or the vapor deposition method. After that, a mask is applied to a central portion of the conductive layer, and then a conductive material is deposited on only the both end portions by means of the sputtering method or the vapor deposition method. Accordingly, it is possible to form the conductive layer in which the thickness differs between the central portion and the both end portions.

The both end portions having the large thicknesses, which are included in the conductive layer 56 formed as described above, are provided as the first electrode 40 and the second electrode 41 respectively. The central portion having the small thickness is provided as the resistor layer 42 which has the large electric resistance as compared with the first electrode 40 and the second electrode 41. In this arrangement, the first electrode 40, the second electrode 41, and the resistor layer 42 can be formed of the same conductive material merely by changing the thickness of the conductive material. Therefore, it is easy to form the electrodes 40, 41 and the resistor layer 42 on the nozzle plate 13. It is possible to reduce the cost as well.

Seventh Modified Embodiment

It is not necessarily indispensable that the liquid repellence (wetting angle) of the lower surface of the nozzle plate 13 is always lower than the liquid repellence of the surface of the insulating layer 43 (wetting angle of the former is lower than that of the latter). For example, it is also appropriate that the liquid droplet is moved to the liquid-attractive area 45 in which the lower surface of the nozzle plate 13 is exposed, when the electric potential of the second electrode 41 is switched to the ground electric potential after the liquid droplet arrives at the second electrode 41. In order to provide such a situation, it is enough that the liquid repellence of the lower surface of the nozzle plate 13 is lower than at least the liquid repellence of the insulating layer 43 provided when the second electrode 41 is at the ground electric potential.

Further, the present invention does not exclude such a case that the nozzle plate 13 is formed of a material having extremely high surface liquid repellence (for example, a material having liquid repellence equivalent to that of the fluorine-based resin or the like for forming the insulating layer 43). Even when the base material surface itself of the nozzle plate 13 has the high liquid repellence as described above, if a liquid-attractive layer, which is composed of a material having surface liquid repellence lower than that of the insulating layer 43 to cover the second electrode 41, is formed in the surrounding area of the second electrode 41, then it is possible to provide the liquid-attractive area.

Eighth Modified Embodiment

It is necessary that the nozzle plate 13 of the ink-jet head 1, on which the liquid droplet transport apparatus is provided, has the insulating property on at least the lower surface so that the first electrode 40, the second electrode 41, and the resistor layer 42 can be arranged. However, it is not necessarily indispensable that the entire nozzle plate 13 is formed of any insulating material. Therefore, the nozzle plate 13 may be a plate made of metal in which the lower surface thereof is coated with any insulating material.

In the embodiments and the modified embodiments described above, the arrangement of the first electrode and the second electrode and the resistor layer arranged therebetween can be arbitrarily set depending on, for example, the route and the direction in which the liquid droplets are transported. For example, in the second embodiment, the first electrode is formed in the area of the nozzle plate 13 disposed in the vicinity of the nozzle 20, and the second electrode 41 is formed in the area separated in the scanning direction from the nozzle 20. The ink is transported from the position which is disposed in the vicinity of the nozzle to another position which is separated from the nozzle, by applying the predetermined electric potentials to the first and second electrodes. However, if necessary, when the first and second electrodes are arranged inversely (in other words, when the electric potentials to be applied to the first and second electrodes are inversed), then the ink can be also transported from the position which is separated from the nozzle to the position which is disposed in the vicinity of the nozzle.

The embodiments of the present invention explained above are examples in which the present invention is applied to the liquid droplet transport apparatus for transporting the ink having the conductivity. However, the present invention is also applicable to any liquid droplet transport apparatus for transporting any liquid droplet other than the ink for the image recording. The present invention is also applicable, for example, to the apparatus for forming the wiring pattern by transferring, to the substrate, the conductive liquid dispersed with metal nanoparticles, the apparatus for producing the DNA chip by using the solution dispersed with DNA, the apparatus for producing the display panel by using the solution dispersed with the EL light emission material such as any organic compound, and the apparatus for producing the color filter for the liquid crystal display by using the liquid dispersed with the pigment for the color filter.

The liquid, which is usable for the liquid droplet transport apparatus of the present invention, is not limited to those in which the liquid itself is conductive. It is also allowable to use those provided with the conductivity which is the same as or equivalent to that of the conductive liquid, by dispersing any conductive additive in any insulative liquid.

What is claimed is:

1. A liquid droplet transport apparatus which transports a conductive liquid droplet, the liquid droplet transport apparatus comprising:

a substrate;

a first electrode and a second electrode which are arranged on a surface of the substrate;

an electric potential-applying mechanism which applies electric potentials to the first electrode and the second electrode respectively;

a resistor layer which is arranged on the surface of the substrate so that the resistor layer makes contact with both of the first electrode and the second electrode, and the resistor layer, makes electric conduction to both of the first electrode and the second electrode, and which causes an electric potential drop between the first and second electrodes when the electric potentials applied to the first electrode and the second electrode by the electric potential-applying mechanism are different; and an insulating layer which covers the first electrode, the second electrode, and the resistor layer, wherein the liquid repellence of an surface of the insulating layer on which the liquid droplet is placed is lowered as an electric potential difference is increased between the surface of the insulating layer and corresponding one of the first and second electrodes and the resistor layer covered with the insulating layer.

2. The liquid droplet transport apparatus according to claim 1, wherein the resistor layer is arranged in an area between the first electrode and the second electrode on the substrate surface.

3. The liquid droplet transport apparatus according to claim 2, wherein the first electrode and the second electrode extend in parallel to each other on the substrate surface.

4. The liquid droplet transport apparatus according to claim 1, wherein the first electrode, the second electrode, and the resistor layer are formed of a same conductive material; and a thickness of the resistor layer is smaller than thickness of each of the first electrode and the second electrode.

5. The liquid droplet transport apparatus according to claim 1, wherein the electric potential-applying mechanism applies a predetermined electric potential to the second electrode such that an electric potential difference between the second electrode and the liquid droplet is greater than an electric potential difference between the first electrode and the liquid droplet; and a liquid-attractive area, in which liquid repellence is always lower than that of the surface of the insulating layer, is provided in a surrounding area of the substrate surface around the second electrode, the surrounding area being not covered with the insulating layer.

6. The liquid droplet transport apparatus according to claim 1, wherein the electric potential-applying mechanism is capable of switching two modes of:

a waiting mode in which the electric potentials applied to the first electrode and the second electrode are same; and a liquid droplet transport mode in which the electric potentials applied to the first electrode and the second electrode made to be different so as to move the liquid droplet along the resistor layer.

7. The liquid droplet transport apparatus according to claim 1, wherein the second electrode has a plurality of individual electrodes;

the individual electrodes are aligned with a spacing distance on the substrate surface; and adjoining individual electrodes among the individual electrodes are connected to each other via the resistor layer.

8. The liquid droplet transport apparatus according to claim 1, wherein the liquid droplet transport apparatus is provided in a liquid droplet discharge apparatus which discharges the liquid droplet from a predetermined discharge port;

the discharge port of the liquid droplet discharge apparatus is arranged on the surface of the substrate;

the first electrode is provided on the surface of the substrate at a surrounding position around the discharge port, and the second electrode is provided on the substrate surface at a position separated and away from the discharge port with respect to the first electrode;

the resistor layer makes electric conduction to both of the first electrode and the second electrode; and the electric potential-applying mechanism applies a predetermined electric potential to the second electrode such that an electric potential difference between the second electrode and the liquid droplet is greater than an electric potential difference between the first electrode and the liquid droplet, and the liquid droplet, which is adhered to surroundings of the discharge port, is transported from the first electrode to the second electrode on the resistor layer.

9. The liquid droplet transport apparatus according to claim 1, further comprising:

a liquid chamber which is provided on the surface of the substrate and an outlet port which guides the liquid droplet from the liquid chamber to transport the liquid droplet guided from the liquid chamber on the surface of the substrate, wherein the first electrode is provided in the vicinity of the outlet port on the surface of the substrate, and the second electrode is provided separately away from the outlet port with respect to the first electrode on the substrate surface;

the electric potential-applying mechanism applies, to the first electrode, an electric potential different from an electric potential of the liquid contained in the liquid chamber to guide the liquid droplet from the liquid chamber; and the electric potential-applying mechanism applies a predetermined electric potential to the second electrode such that an electric potential difference between the second electrode and the liquid droplet is greater than an electric potential difference between the first electrode and the liquid droplet, and that the liquid droplet which is guided from the liquid chamber is transported from the first electrode to the second electrode on the resistor layer.

10. The liquid droplet transport apparatus according to claim 9, wherein a period of time, during which the electric potential-applying mechanism applies the electric potential different from the electric potential of the liquid to the first electrode, is adjusted to change a size of the liquid droplet to be guided from the liquid chamber.

11. The liquid droplet transport apparatus according to claim 10, wherein the outlet port includes a plurality of individual outlet ports;

a plurality of individual flow passages, which are branched from the liquid chamber, are formed on the substrate, each of the individual outlet ports being provided at one end of one of the individual flow passages;

the first and second electrodes includes a plurality of first and second individual electrodes, respectively, each of the first individual electrodes and each of the second individual electrodes being arranged in one of the individual flow passages; and the electric potential-applying mechanism applies the electric potentials independently to each of the first and second individual electrodes.

12. The liquid droplet transport apparatus according to claim 11, wherein each of the first individual electrodes is formed at a boundary of one of the individual flow passages with respect to the liquid chamber; and each of the second individual electrodes is formed in the vicinity of one of the individual outlet ports of one of the individual flow passages.

13. The liquid droplet transport apparatus according to claim 1, wherein the resistor layer is formed of a material selected from the group consisting of graphite, carbon, high purity carbon/pyrolytic boron nitride, aluminum nitride, and tungsten.

14. The liquid droplet transport apparatus according to claim 1, wherein the insulating layer is formed of a fluorine-based resin.

15. The liquid droplet transport apparatus according to claim 1, wherein the electrical potential-applying mechanism applies a predetermined electric potential to the second electrode so that an electric potential difference between the second electrode and the liquid droplet is greater than an electric potential difference between the first electrode and the liquid droplet, in order to transfer the liquid droplet in a direction from the first electrode toward the second electrode.

* * * * *